US009055379B2

(12) United States Patent
Puria et al.

(10) Patent No.: US 9,055,379 B2
(45) Date of Patent: Jun. 9, 2015

(54) OPTICALLY COUPLED ACOUSTIC MIDDLE EAR IMPLANT SYSTEMS AND METHODS

(75) Inventors: Sunil Puria, Sunnyvale, CA (US); Rodney C. Perkins, Woodside, CA (US); Paul Rucker, San Francisco, CA (US)

(73) Assignee: EARLENS CORPORATION, Menlo Park, CA (US)

( * ) Notice: Subject to any disclaimer, the term of this patent is extended or adjusted under 35 U.S.C. 154(b) by 515 days.

(21) Appl. No.: 12/794,969

(22) Filed: Jun. 7, 2010

(65) Prior Publication Data

US 2010/0312040 A1 Dec. 9, 2010

Related U.S. Application Data

(60) Provisional application No. 61/219,286, filed on Jun. 22, 2009, provisional application No. 61/184,563, filed on Jun. 5, 2009.

(51) Int. Cl.
*H04R 25/00* (2006.01)

(52) U.S. Cl.
CPC ..... *H04R 25/606* (2013.01); *H04R 25/453* (2013.01); *H04R 2225/49* (2013.01)

(58) Field of Classification Search
CPC ..... H04R 25/606; H04R 25/453; H04R 2225/49; H04R 2225/025; H04R 2225/43; H04R 23/008; A61N 1/36032
USPC ..... 381/23.1, 312–331; 600/25
See application file for complete search history.

(56) References Cited

U.S. PATENT DOCUMENTS 3,209,082 A 9/1965 McCarrell et al.
3,440,314 A 4/1969 Frisch (Continued)

FOREIGN PATENT DOCUMENTS

CN 1176731 A 3/1998
DE 2044870 3/1972

(Continued)

OTHER PUBLICATIONS

Web Books Publishing, "The Ear," accessed online Jan. 22, 2013, available online Nov. 2, 2007 at http://www.web-books.com/eLibrary/Medicine/Physiology/Ear/Ear.htm.*

(Continued)

*Primary Examiner* — Jacqueline Cheng
*Assistant Examiner* — Kaylee Wilson
(74) *Attorney, Agent, or Firm* — Wilson Sonsini Goodrich & Rosati

(57) ABSTRACT

An assembly comprising a sound transducer can be implanted in the middle ear in a manner that simplifies surgery. The assembly may comprise a narrow cross-sectional profile such that the assembly can be positioned in the middle ear through an incision in the eardrum, for example without cutting bone. The incision can be closed and electromagnetic energy transmitted through the closed incision to a transducer configured to vibrate the ear in response to the electromagnetic energy. In many embodiments, the sound transducer comprises a speaker positioned in the middle ear, and the sound transducer can couple to vibratory structure of the ear with air so as to simplify surgery. The assembly may be affixed to a substantially fixed structure of the ear, for example the promontory, so as to inhibit user perceivable occlusion and inhibit motion of the assembly, such that the user can perceive clear sound with little occlusion.

33 Claims, 14 Drawing Sheets

(56) References Cited

U.S. PATENT DOCUMENTS 3,549,818 A 12/1970 Turner et al.
3,585,416 A 6/1971 Mellen
3,594,514 A 7/1971 Wingrove
3,710,399 A 1/1973 Hurst
3,712,962 A 1/1973 Epley
3,764,748 A 10/1973 Branch et al.
3,808,179 A 4/1974 Gaylord
3,882,285 A 5/1975 Nunley et al.
3,985,977 A 10/1976 Beaty et al.
4,002,897 A 1/1977 Kleinman et al.
4,061,972 A 12/1977 Burgess
4,075,042 A 2/1978 Das
4,098,277 A 7/1978 Mendell
4,109,116 A 8/1978 Victoreen
4,120,570 A 10/1978 Gaylord
4,248,899 A 2/1981 Lyon et al.
4,252,440 A 2/1981 Frosch et al.
4,303,772 A 12/1981 Novicky
4,319,359 A 3/1982 Wolf
4,334,315 A 6/1982 Ono et al.
4,334,321 A 6/1982 Edelman
4,339,954 A 7/1982 Anson et al.
4,357,497 A 11/1982 Hochmair et al.
4,380,689 A 4/1983 Giannetti
4,428,377 A 1/1984 Zollner et al.
4,524,294 A 6/1985 Brody
4,540,761 A 9/1985 Kawamura et al.
4,556,122 A 12/1985 Goode
4,592,087 A 5/1986 Killion
4,606,329 A 8/1986 Hough
4,611,598 A 9/1986 Hortmann et al.
4,628,907 A 12/1986 Epley
4,641,377 A 2/1987 Rush et al.
4,654,554 A 3/1987 Kishi
4,689,819 A 8/1987 Killion
4,696,287 A 9/1987 Hortmann et al.
4,729,366 A 3/1988 Schaefer
4,741,339 A 5/1988 Harrison et al.
4,742,499 A 5/1988 Butler
4,756,312 A 7/1988 Epley
4,766,607 A 8/1988 Feldman
4,774,933 A 10/1988 Hough et al.
4,776,322 A 10/1988 Hough et al.
4,782,818 A 11/1988 Mori
4,800,884 A 1/1989 Heide et al.
4,800,982 A 1/1989 Carlson
4,817,607 A 4/1989 Tatge
4,840,178 A 6/1989 Heide et al.
4,845,755 A 7/1989 Busch et al.
4,865,035 A 9/1989 Mori
4,932,405 A 6/1990 Peeters et al.
4,936,305 A 6/1990 Ashtiani et al.
4,944,301 A 7/1990 Widin et al.
4,948,855 A 8/1990 Novicky
4,957,478 A 9/1990 Maniglia
4,999,819 A 3/1991 Newnham et al.
5,003,608 A 3/1991 Carlson
5,012,520 A 4/1991 Steeger
5,015,224 A 5/1991 Mariglia
5,015,225 A 5/1991 Hough et al.
5,031,219 A 7/1991 Ward et al.
5,061,282 A 10/1991 Jacobs
5,066,091 A 11/1991 Stoy et al.
5,094,108 A 3/1992 Kim et al.
5,117,461 A 5/1992 Moseley
5,142,186 A 8/1992 Cross et al.
5,163,957 A 11/1992 Sade et al.
5,167,235 A 12/1992 Seacord et al.
5,201,007 A 4/1993 Ward et al.
5,259,032 A 11/1993 Perkins et al.
5,272,757 A 12/1993 Scofield et al.
5,276,910 A 1/1994 Buchele
5,277,694 A * 1/1994 Leysieffer et al. ..... 600/25
5,360,388 A * 11/1994 Spindel et al. ..... 600/25
5,378,933 A 1/1995 Pfannenmueller et al.
5,402,496 A 3/1995 Soli et al.
5,411,467 A 5/1995 Hortmann et al.
5,425,104 A 6/1995 Shennib
5,440,082 A 8/1995 Claes
5,440,237 A 8/1995 Brown et al.
5,455,994 A 10/1995 Termeer et al.
5,456,654 A 10/1995 Ball
5,531,787 A 7/1996 Lesinski et al.
5,531,954 A 7/1996 Heide et al.
5,535,282 A 7/1996 Luca
5,554,096 A 9/1996 Ball
5,558,618 A 9/1996 Maniglia
5,572,594 A 11/1996 Devoe et al.
5,606,621 A 2/1997 Reiter et al.
5,624,376 A 4/1997 Ball et al.
5,707,338 A 1/1998 Adams et al.
5,715,321 A 2/1998 Andrea et al.
5,721,783 A 2/1998 Anderson
5,722,411 A 3/1998 Suzuki et al.
5,729,077 A 3/1998 Newnham et al.
5,740,258 A 4/1998 Goodwin-Johansson
5,749,912 A 5/1998 Zhang et al.
5,762,583 A 6/1998 Adams et al.
5,772,575 A 6/1998 Lesinski et al.
5,774,259 A 6/1998 Saitoh et al.
5,782,744 A 7/1998 Money
5,788,711 A 8/1998 Lehner et al.
5,795,287 A 8/1998 Ball et al.
5,797,834 A 8/1998 Goode
5,800,336 A 9/1998 Ball et al.
5,804,109 A 9/1998 Perkins
5,804,907 A 9/1998 Park et al.
5,814,095 A 9/1998 Muller et al.
5,825,122 A 10/1998 Givargizov et al.
5,836,863 A 11/1998 Bushek et al.
5,842,967 A 12/1998 Kroll
5,857,958 A 1/1999 Ball et al.
5,859,916 A 1/1999 Ball et al.
5,879,283 A 3/1999 Adams et al.
5,888,187 A 3/1999 Jaeger et al.
5,897,486 A 4/1999 Ball et al.
5,899,847 A 5/1999 Adams et al.
5,900,274 A 5/1999 Chatterjee et al.
5,906,635 A 5/1999 Maniglia
5,913,815 A 6/1999 Ball et al.
5,922,077 A 7/1999 Espy et al.
5,940,519 A 8/1999 Kuo
5,949,895 A 9/1999 Ball et al.
5,984,859 A 11/1999 Lesinski
5,987,146 A 11/1999 Pluvinage et al.
6,005,955 A 12/1999 Kroll et al.
6,024,717 A 2/2000 Ball et al.
6,045,528 A 4/2000 Arenberg et al.
6,050,933 A 4/2000 Bushek et al.
6,068,589 A 5/2000 Neukermans
6,068,590 A 5/2000 Brisken
6,084,975 A 7/2000 Perkins
6,093,144 A 7/2000 Jaeger et al.
6,137,889 A 10/2000 Shennib et al.
6,139,488 A 10/2000 Ball
6,153,966 A 11/2000 Neukermans
6,174,278 B1 1/2001 Jaeger et al.
6,181,801 B1 1/2001 Puthuff et al.
6,190,305 B1 2/2001 Ball et al.
6,190,306 B1 2/2001 Kennedy
6,208,445 B1 3/2001 Reime
6,217,508 B1 4/2001 Ball et al.
6,222,302 B1 4/2001 Imada et al.
6,222,927 B1 4/2001 Feng et al.
6,240,192 B1 5/2001 Brennan et al.
6,241,767 B1 6/2001 Stennert et al.
6,261,224 B1 7/2001 Adams et al.
6,277,148 B1 8/2001 Dormer
6,312,959 B1 11/2001 Datskos
6,339,648 B1 1/2002 McIntosh et al.
6,354,990 B1 3/2002 Juneau et al.
6,366,863 B1 4/2002 Bye et al.
6,385,363 B1 5/2002 Rajic et al.
6,387,039 B1 5/2002 Moses

(56) References Cited

U.S. PATENT DOCUMENTS 6,393,130 B1 5/2002 Stonikas et al.
6,422,991 B1 7/2002 Jaeger
6,432,248 B1 8/2002 Popp et al.
6,436,028 B1 8/2002 Dormer
6,438,244 B1 8/2002 Juneau et al.
6,445,799 B1 9/2002 Taenzer et al.
6,473,512 B1 10/2002 Juneau et al.
6,475,134 B1 11/2002 Ball et al.
6,491,644 B1 12/2002 Vujanic et al.
6,493,453 B1 12/2002 Glendon
6,493,454 B1 12/2002 Loi et al.
6,498,858 B2 12/2002 Kates
6,519,376 B2 2/2003 Biagi et al.
6,536,530 B2 3/2003 Schultz et al.
6,537,200 B2 3/2003 Leysieffer et al.
6,549,633 B1 4/2003 Westermann
6,554,761 B1 4/2003 Puria et al.
6,575,894 B2 6/2003 Leysieffer et al.
6,592,513 B1 7/2003 Kroll et al.
6,603,860 B1 8/2003 Taenzer et al.
6,620,110 B2 9/2003 Schmid
6,626,822 B1 9/2003 Jaeger et al.
6,629,922 B1 10/2003 Puria et al.
6,668,062 B1 12/2003 Luo et al.
6,676,592 B2 1/2004 Ball et al.
6,695,943 B2 2/2004 Desporte et al.
6,724,902 B1 4/2004 Shennib et al.
6,728,024 B2 4/2004 Ribak
6,735,318 B2 5/2004 Cho
6,754,358 B1 6/2004 Boeson et al.
6,754,537 B1 6/2004 Harrison et al.
6,801,629 B2 10/2004 Brimhall et al.
6,829,363 B2 12/2004 Sacha
6,842,647 B1 1/2005 Griffith et al.
6,888,949 B1 5/2005 Vanden Berghe et al.
6,900,926 B2 5/2005 Ribak
6,912,289 B2 6/2005 Vonlanthen et al.
6,920,340 B2 7/2005 Laderman
6,940,989 B1 9/2005 Shennib et al.
D512,979 S 12/2005 Corcoran et al.
6,975,402 B2 12/2005 Bisson et al.
6,978,159 B2 12/2005 Feng et al.
7,024,010 B2 * 4/2006 Saunders et al. ..... 381/317
7,043,037 B2 5/2006 Lichtblau
7,050,675 B2 5/2006 Zhou
7,057,256 B2 6/2006 Carey, III et al.
7,058,182 B2 6/2006 Kates
7,072,475 B1 7/2006 DeNap et al.
7,076,076 B2 7/2006 Bauman
7,095,981 B1 8/2006 Voroba et al.
7,167,572 B1 1/2007 Harrison et al.
7,174,026 B2 2/2007 Niederdrank
7,203,331 B2 4/2007 Boesen
7,239,069 B2 7/2007 Cho
7,245,732 B2 7/2007 Jorgensen et al.
7,255,457 B2 8/2007 Ducharme et al.
7,289,639 B2 10/2007 Abel et al.
7,322,930 B2 1/2008 Jaeger et al.
7,349,741 B2 3/2008 Maltan et al.
7,354,792 B2 4/2008 Carey, III et al.
7,376,563 B2 5/2008 Leysieffer et al.
7,390,689 B2 6/2008 Mazur et al.
7,394,909 B1 7/2008 Widmer et al.
7,421,087 B2 9/2008 Perkins et al.
7,424,122 B2 9/2008 Ryan
7,444,877 B2 11/2008 Li et al.
7,547,275 B2 6/2009 Cho
7,668,325 B2 2/2010 Puria et al.
2001/0003788 A1 6/2001 Ball et al.
2001/0027342 A1 10/2001 Dormer
2001/0043708 A1 11/2001 Brimhall
2001/0053871 A1 * 12/2001 Zilberman et al. ..... 600/25
2002/0012438 A1 1/2002 Leysieffer et al.
2002/0029070 A1 3/2002 Leysieffer et al.
2002/0030871 A1 3/2002 Anderson et al.
2002/0035309 A1 3/2002 Leysieffer
2002/0086715 A1 7/2002 Sahagen
2002/0172350 A1 11/2002 Edwards et al.
2002/0183587 A1 12/2002 Dormer
2003/0064746 A1 4/2003 Rader et al.
2003/0097178 A1 5/2003 Roberson et al.
2003/0125602 A1 7/2003 Sokolich et al.
2003/0142841 A1 7/2003 Wiegand
2003/0208099 A1 11/2003 Ball
2004/0165742 A1 8/2004 Shennib et al.
2004/0184732 A1 9/2004 Zhou
2004/0208333 A1 10/2004 Cheung et al.
2004/0234089 A1 11/2004 Rembrand et al.
2004/0234092 A1 11/2004 Wada et al.
2004/0240691 A1 12/2004 Grafenberg
2005/0020873 A1 1/2005 Berrang et al.
2005/0036639 A1 2/2005 Bachler et al.
2005/0111683 A1 * 5/2005 Chabries et al. ..... 381/317
2005/0163333 A1 * 7/2005 Abel et al. ..... 381/315
2005/0226446 A1 10/2005 Luo et al.
2006/0023908 A1 2/2006 Perkins et al.
2006/0058573 A1 3/2006 Neisz et al.
2006/0062420 A1 3/2006 Araki
2006/0107744 A1 5/2006 Li et al.
2006/0161255 A1 7/2006 Zarowski et al.
2006/0177079 A1 8/2006 Baekgaard Jensen et al.
2006/0183965 A1 8/2006 Kasic, II et al.
2006/0189841 A1 8/2006 Pluvinage
2006/0231914 A1 10/2006 Carey, III et al.
2006/0233398 A1 10/2006 Husung
2007/0083078 A1 4/2007 Easter et al.
2007/0100197 A1 5/2007 Perkins et al.
2007/0127748 A1 6/2007 Carlile et al.
2007/0135870 A1 6/2007 Shanks et al.
2007/0161848 A1 7/2007 Dalton et al.
2007/0191673 A1 8/2007 Ball et al.
2007/0225776 A1 9/2007 Fritsch et al.
2007/0236704 A1 10/2007 Carr
2007/0250119 A1 10/2007 Tyler et al.
2007/0251082 A1 11/2007 Milojevic et al.
2007/0286429 A1 12/2007 Grafenberg et al.
2008/0021518 A1 1/2008 Hochmair et al.
2008/0051623 A1 2/2008 Schneider et al.
2008/0107292 A1 5/2008 Kornagel
2008/0188707 A1 8/2008 Bernard et al.
2008/0298600 A1 12/2008 Poe et al.
2009/0023976 A1 * 1/2009 Cho et al. ..... 600/25
2009/0043149 A1 2/2009 Abel et al.
2009/0092271 A1 4/2009 Fay et al.
2009/0097681 A1 * 4/2009 Puria et al. ..... 381/318
2009/0141919 A1 6/2009 Spitaels et al.
2010/0034409 A1 2/2010 Fay et al.
2010/0048982 A1 2/2010 Puria et al.
2010/0317914 A1 12/2010 Puria et al.

FOREIGN PATENT DOCUMENTS

DE 3243850 A1 5/1984
DE 3508830 A1 9/1986
EP 0 242 038 A2 10/1987
EP 0 291 325 A2 11/1988
EP 0 296 092 12/1988
EP 0 352 954 A2 1/1990
EP 1035753 A1 9/2000
EP 1 845 919 A1 10/2007
FR 2455820 11/1980
GB 2085694 A * 4/1982 ..... H04R 11/00
JP 60-154800 8/1985
JP 09-327098 12/1997
KR 10-0624445 B1 9/2006
WO WO 92/09181 A1 5/1992
WO WO 97/36457 A1 10/1997
WO WO 97/45074 A1 12/1997
WO WO 98/06236 A1 2/1998
WO WO 99/03146 1/1999
WO WO 99/15111 4/1999
WO WO 01/50815 A1 7/2001
WO WO 01/58206 A2 8/2001
WO WO 02/39874 A2 5/2002

(56) References Cited

FOREIGN PATENT DOCUMENTS

| | | | | |
|---|---|---|---|---|
| WO | WO 03/063542 | A2 | 7/2003 | |
| WO | WO 2004/010733 | A1 | 1/2004 | |
| WO | WO 2005/015952 | | 2/2005 | |
| WO | WO 2006/042298 | A2 | 4/2006 | |
| WO | WO 2006/075169 | | 7/2006 | |
| WO | WO 2006/075175 | | 7/2006 | |
| WO | WO 2006075175 | A1 * | 7/2006 | ..... H04R 25/00 |
| WO | WO 2009/047370 | A2 | 4/2009 | |
| WO | WO 2009/056167 | A1 | 5/2009 | |

OTHER PUBLICATIONS

Atasoy [Paper] "Opto-acoustic Imaging" for BYM504E Biomedical Imaging Systems class at ITU, downloaded from the Internet <<http://www2.itu.edu.tr/~cilesiz/courses/BYM504-2005-OA_504041413.pdf>>, 14 pages, presented May 13, 2005.

Athanassiou et al., "Laser Controlled Photomechanical Actuation of Photochromic Polymers Microsystems" Rev. Adv. Mater. Sci., 2003; 5:245-251.

Ayatollahi et al., "Design and Modeling of Micromachined Condenser MEMS Loudspeaker using Permanent Magnet Neodymium—Iron—Boron (Nd—Fe—B)," IEEE International Conference on Semiconductor Electronics, 2006. ICSE '06, Oct. 29, 2006-Dec. 1, 2006; pp. 160-166.

Baer et al., "Effects of Low Pass Filtering on the Intelligibility of Speech in Noise for People With and Without Dead Regions at High Frequencies," J Acoust Soc Am. Sep. 2002;112(3 Pt 1):1133-1144.

Best et al., "Influence of High Frequencies on Speech Locatisation," Abstract 981, Feb. 24, 2003, retrieved from: http://www.aro.org/abstracts.html.

Birch et al., "Microengineered Systems for the Hearing Impaired," IEE Colloquium on Medical Applications of Microengineering, Jan. 31, 1996; pp. 2/1-2/5.

Burkhard et al., "Anthropometric Manikin for Acoustic Research," J Acoust Soc Am. Jul. 1975;58(1):214-22.

Camacho-Lopez et al., "Fast Liquid Crystal Elastomer Swims Into the Dark," Electronic Liquid Crystal Communications, (Nov. 26, 2003), 9 pages total.

Carlile et al., Abstract 1264—"Spatialisation of Talkers and the Segregation of Concurrent Speech ," Feb. 24, 2004, retrieved from: http://www.aro.org/archives/2004/2004_1264.html.

Cheng et al., "A Silicon Microspeaker for Hearing Instruments," Journal of Micromechanics and Microengineering 2004; 14(7):859-866.

Datskos et al., "Photoinduced and Thermal Stress in Silicon Microcantilevers", Applied Physics Letters, Oct. 19, 1998; 73(16):2319-2321.

Decraemer et al., "A Method for Determining Three-Dimensional Vibration in the Ear," *Hearing Research*, 77 (1-2): 19-37 (1994).

"EAR", Retrieved from the Internet: <<http://wwwmgs.bionet.nsc.ru/mgs/gnw/trrd/thesaurus/Se/ear.html>>, downloaded on Jun. 17, 2008, 4 pages total.

Fay, "Cat Ear Drum Mechanics," Ph.D. thesis, Dissertation submitted to Department of Aeronautics and Astronautics, Stanford University, May 2001, 210 pages total.

Fay et al., "Cat Eardrum Response Mechanics," in Calladine Festschrift, edited by S. Pellegrino Kluwer Academic Publishers, The Netherlands, 2002; 10 pages total.

Fletcher, "Effects of Distortion on the Individual Speech Sounds", Chapter 18, *ASA Edition of Speech and Hearing in Communication*, Acoust Soc.of Am. (republished in 1995) pp. 415-423.

Freyman et al., "Spatial Release from Informational Masking in Speech Recognition," J Acoust Soc Am. May 2001;109(5 Pt 1):2112-2122.

Freyman et al., "The Role of Perceived Spatial Separation in the Unmasking of Speech," J Acoust Soc Am. Dec. 1999;106(6):3578-3588.

Gennum, GA3280 Preliminary Data Sheet: Voyageur TD Open Platform DSP System for Ultra Low Audio Processing, downloaded from the Internet: <<http://www.sounddesigntechnologies.com/products/pdf/37601DOC.pdf>>, Oct. 2006; 17 pages.

Hato et al., "Three-Dimensional Stapes Footplate Motion in Human Temporal Bones." Audiol Neurootol , 2003; 8: 140-152.

"Headphones" Wikipedia Entry, downloaded from the Internet : <<http://en.wikipedia.org/wiki/Headphones>>, downloaded on Oct. 27, 2008, 7 pages total.

Hofman et al., "Relearning Sound Localization With New Ears," Nat Neurosci. Sep. 1998;1(5):417-421.

Izzo et al., "Laser Stimulation of the Auditory Nerve," Lasers Surg Med. Sep. 2006;38(8):745-753.

Izzo et al, "Laser Stimulation of Auditory Neurons: Effect of Shorter Pulse Duration and Penetration Depth," Biophys J. Apr. 15, 2008;94(8):3159-3166.

Izzo et al., "Selectivity of Neural Stimulation in the Auditory System: A Comparison of Optic and Electric Stimuli," J Biomed Opt. Mar.-Apr. 2007;12(2):021008.

Jin et al., "Speech Localization", J. Audio Eng. Soc. convention paper, presented at the *AES* 112th Convention, Munich, Germany, May 10-13, 2002, 13 pages total.

Killion, "Myths About Hearing Noise and Directional Microphones," *The Hearing Review*, vol. 11, No. 2, (Feb. 2004), pp. 14, 16, 18, 19, 72 & 73.

Killion, "SNR loss: I can hear what people say but I can't understand them," The Hearing Review, 1997; 4(12):8-14.

Lee et al., "A Novel Opto-Electromagnetic Actuator Coupled to the tympanic Membrane" Journal of Biomechanics, 2008; 41(16): 3515-3518.

Lee et al., "The Optimal Magnetic Force for a Novel Actuator Coupled to the Tympanic Membrane: A Finite Element Analysis," Biomedical Engineering: Applications, Basis and Communications, 2007; 19(3):171-177.

Lezal, "Chalcogenide Glasses—Survey and Progress", J. Optoelectron Adv Mater., Mar. 2003; 5 (1):23-34.

Markoff, "Intuition+Money: An Aha Moment," New York Times Oct. 11, 2008, p. BU4, 3 pages total.

Martin et al. "Utility of Monaural Spectral Cues is Enhanced in the Presence of Cues to Sound-Source Lateral Angle," JARO, 2004; 5:80-89.

Moore, "Loudness Perception and Intensity Resolution", *Cochlear Hearing Loss*, Whurr Publishers Ltd., (1998), Chapter 4, pp. 90-115.

Murugasu et al., "Malleus-to-footplate versus malleus-to-stapes-head ossicular reconstruction prostheses: temporal bone pressure gain measurements and clinical audiological data," Otol Neurotol. Jul. 2005;26(4):572-582.

Musicant et al., "Direction-Dependent Spectral Properties of Cat External Ear: New Data and Cross-Species Comparisons, " J. Acostic. Soc. Am, May 10-13, 2002, Feb. 1990; 8(2):757-781.

National Semiconductor, LM4673 Boomer: Filterless, 2.65W, Mono, Class D Audio Power Amplifier, [Data Sheet] downloaded from the Internet: <<http://www.national.com/ds/LM/LM4673.pdf>>; Nov. 1, 2007; 24 pages.

O'Connor et al., "Middle ear Cavity and Ear Canal Pressure-Driven Stapes Velocity Responses in Human Cadaveric Temporal Bones," J Acoust Soc Am. Sep. 2006;120(3):1517-28.

Perkins et al., "The EarLens System: New sound transduction methods," Hear Res. Feb. 2, 2010; 10 pages total.

Poosanaas et al., "Influence of Sample thickness on the performance of Photostrictive ceramics," J. App. Phys., Aug. 1998; 84(3):1508-1512.

Puria et al., "Abstract 1112: A Gear in the Middle Ear," ARO Thirtieth Annual MWM, Denver CO, Feb. 13, 2007.

Puria et al., "Malleus-to-Footplate Ossicular Reconstruction Prosthesis Positioning: Cochleovestibular Pressure Optimization", Otol Neurotol. May 2005;26(3):368-379.

Puria and Allen, "Measurements and Model of the Cat Middle Ear: Evidence of Tympanic Membrane Acoustic Delay," Journal of the Acoustical Society of America,.1998; 104 (6): 3463-3481.

Puria et al., "Middle Ear Morphometry From Cadaveric Temporal Bone MicroCT Imaging," Proceedings of the 4th International Symposium, Zurich, Switzerland, Jul. 27-30, 2006, Middle Ear Mechanics in Research and Otology, pp. 259-268.

(56) References Cited

OTHER PUBLICATIONS

Puria et al., "Sound-Pressure Measurements in the Cochlear Vestibule of Human-Cadaver Ears," Journal of the Acoustical Society of America, 101 (5-1): 2754-2770, (1997).
Roush, "SiOnyx Brings "Black Silicon" into the Light; Material Could Upend Solar, Imaging Industries," Xconomy, Oct. 12, 2008, retrieved from the Internet: <<http://www.xconomy.com/boston/2008/10/12/sionyx-brings-black-silicon-into-the-light-material-could-upend-solar-imaging-industries/>> 4 pages total.
Rubinstein, "How Cochlear Implants Encode Speech," Curr Opin Otolaryngol Head Neck Surg. Oct. 2004;12(5):444-8; retrieved from the Internet: <http://www.ohsu.edu/nod/documents/week3/Rubenstein.pdf>.
Sekaric et al., "Nanomechanical Resonant Structures as Tunable Passive Modulators," App. Phys. Lett., Nov. 2003; 80(19): 3617-3619.
Sound Design Technologies, "Voyager TD™ Open Platform DSP System for Ultra Low Power Audio Processing—GA3280 Data Sheet", Oct. 2007; retrieved from the Internet: <<http://www.sound-des.com/pdf/37601DOC.pdf>>, 15 page total.
Shaw, "Transformation of Sound Pressure Level From the Free Field to the Eardrum in the Horizontal Plane," J. Acoust. Soc. Am., Dec. 1974; 56(6):1848-1861.
Shih, "Shape and Displacement Control of Beams with Various Boundary Conditions via Photostrictive optical actuators," Proc. IMECE (Nov. 2003), pp. 1-10.
Shock, "How Deep Brain Stimulation Works for Parkinson's Disease" [website]; retrieved from the Internet: <http://www.shockmd.com/2009/05/11/how-deep-brain-stimulation-worksfor-parkinsons-disease/> on Jun. 18, 2010, 6 pages total.
Stenfelt et al., "Bone-Conducted Sound: Physiological and Clinical Aspects," Otology & Neurotology, Nov. 2005; 26 (6):1245-1261.
Stuchlik et al, "Micro-Nano Actuators Driven by Polarized Light", IEEE Proc. Sci. Meas. Techn. Mar. 2004, 151(2):131-136.
Suski et al., "Optically Activated ZnO/SiO2/Si Cantilever Beams", Sensors & Actuators, 1990; 24:221-225.
Takagi et al.; "Mechanochemical Synthesis of Piezoelectric PLZT Powder", KONA, 2003, 151(21):234-241.
Thakoor et al., "Optical Microactuation in Piezoceramics", Proc. SPIE, Jul. 1998; 3328:376-391.
Tzou et al; "Smart Materials, Precision Sensors/Actuators, Smart Structures, and Structronic Systems", Mechanics of Advanced Materials and Structures, 2004;11:367-393.
Uchino et al.; "Photostricitve actuators," *Ferroelectrics* 2001; 258:147-158.
Vickers et al., "Effects of Low-Pass Filtering on the Intelligibility of Speech in Quiet for People With and Without Dead Regions at High Frequencies," *J Acoust Soc Am*. Aug. 2001;110(2):1164-1175.
Vinikman-Pinhasi et al., "Piezoelectric and Piezooptic Effects in Porous Silicon," Applied Physics Letters, Mar. 2006; 88(11): 111905-111906.
Wang et al., "Preliminary Assessment of Remote Photoelectric Excitation of an Actuator for a Hearing Implant," Proceeding of the 2005 IEEE, Engineering in Medicine and Biology 27th Annual Conference, Shanghai, China, Sep. 1-4, 2005, pp. 6233-6234.
Wiener et al., "On the Sound Pressure Transformation by the Head and Auditory Meatus of the Cat", Acta Otolaryngol. Mar. 1966;61(3):255-269.
Wightman et al., "Monaural Sound Localization Revisited," J Acoust Soc Am. Feb. 1997;101(2):1050-1063.
Yi et al., "Piezoelectric Microspeaker with Compressive Nitride Diaphragm," The Fifteenth IEEE International Conference on Micro Electro Mechanical Systems, 2002; pp. 260-263.
Yu et al. "Directed Bending of a Polymer Film by Light", Nature, Sep. 2003; 425(6954):145.
International Search Report and Written Opinion of PCT Application No. PCT/US2010/037509, mailed Oct. 29, 2010, 18 pages total.
U.S. Appl. No. 60/702,532, filed Jul. 25, 2005, inventor: Nikolai Aljuri.
U.S. Appl. No. 61/099,087, filed Sep. 22, 2008, inventor: Paul Rucker.

* cited by examiner

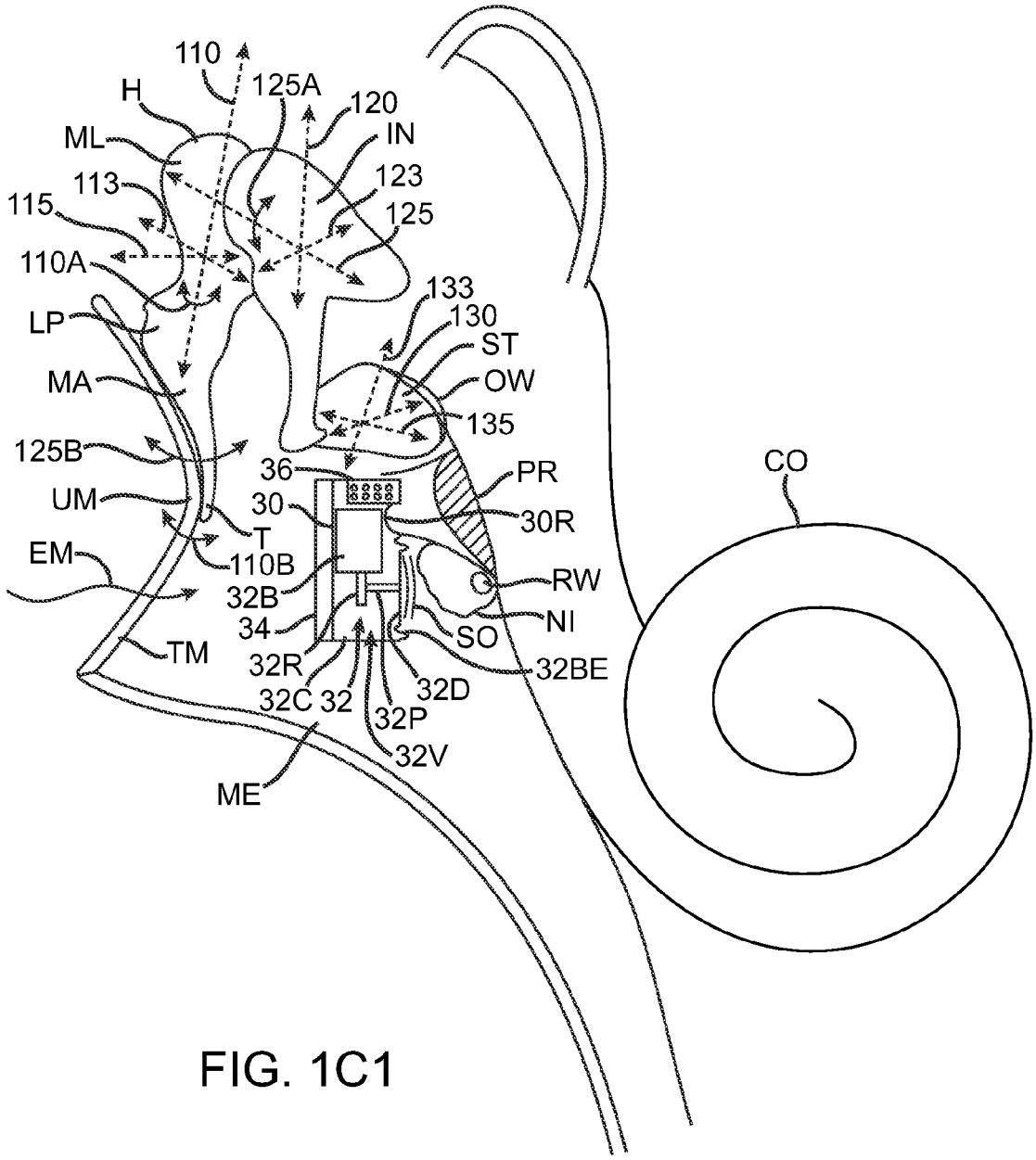
FIG. 1C1

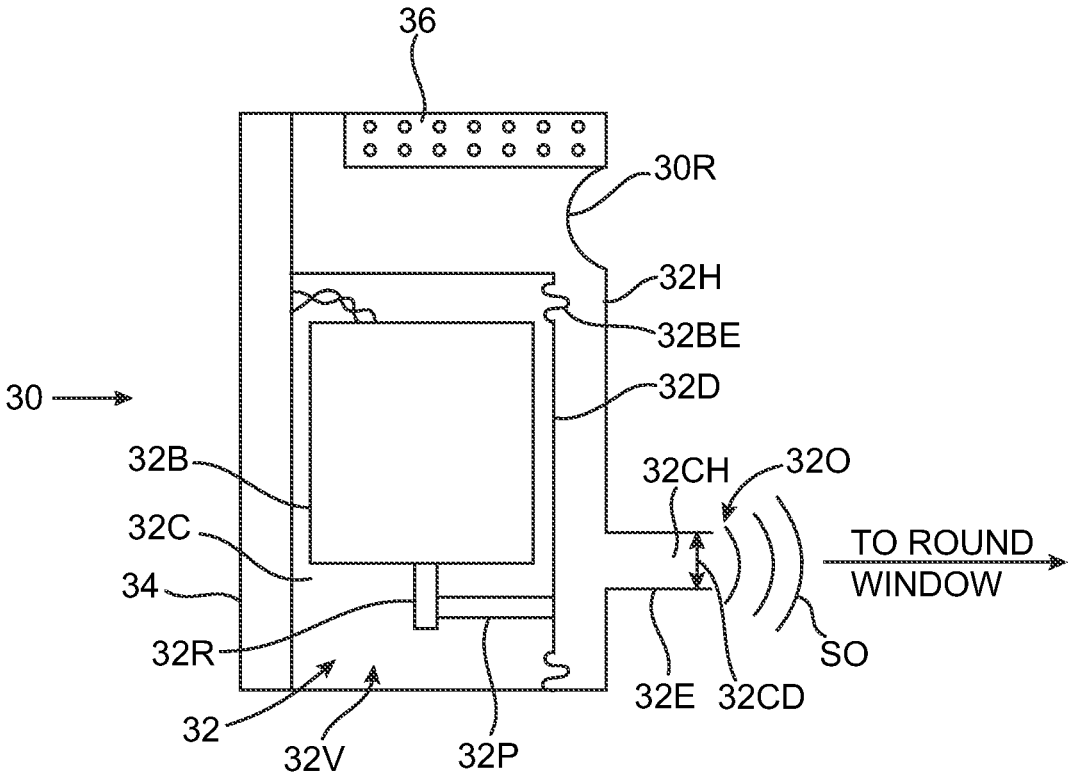
FIG. 1C2

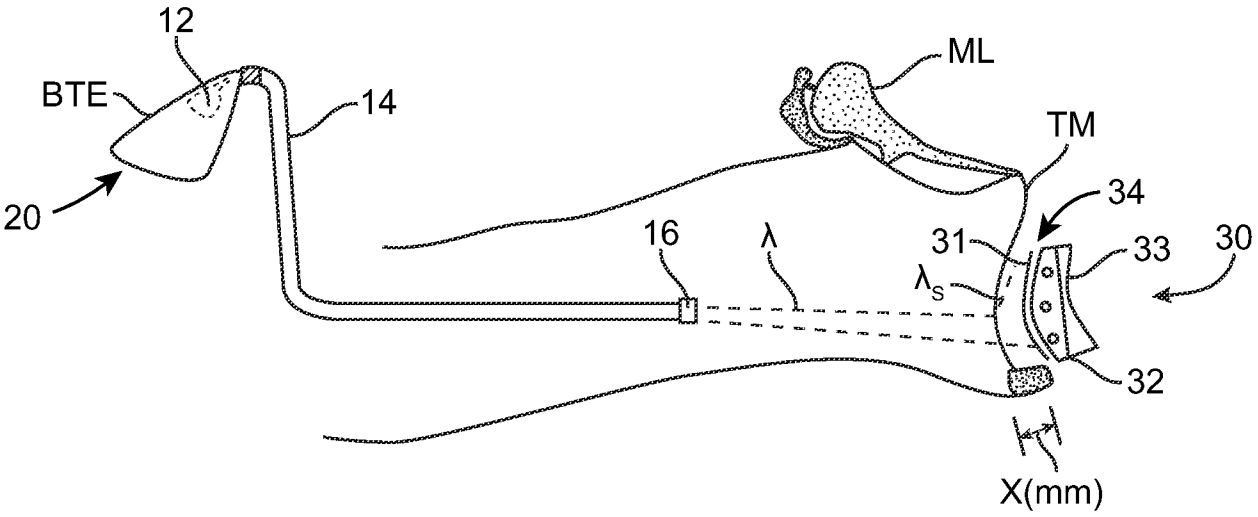
FIG. 1C3

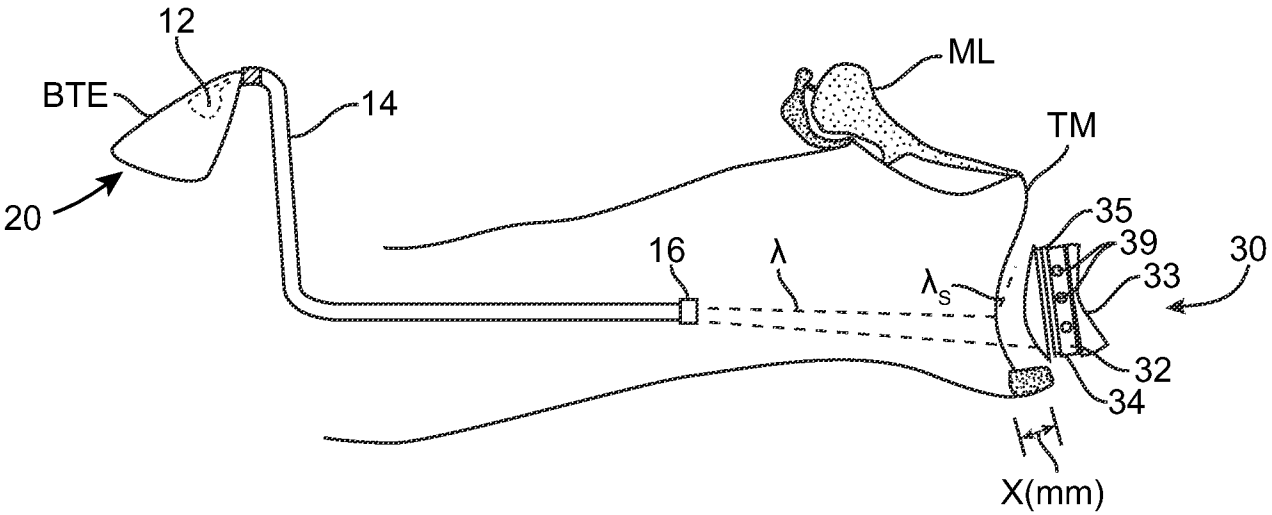
FIG. 1C4

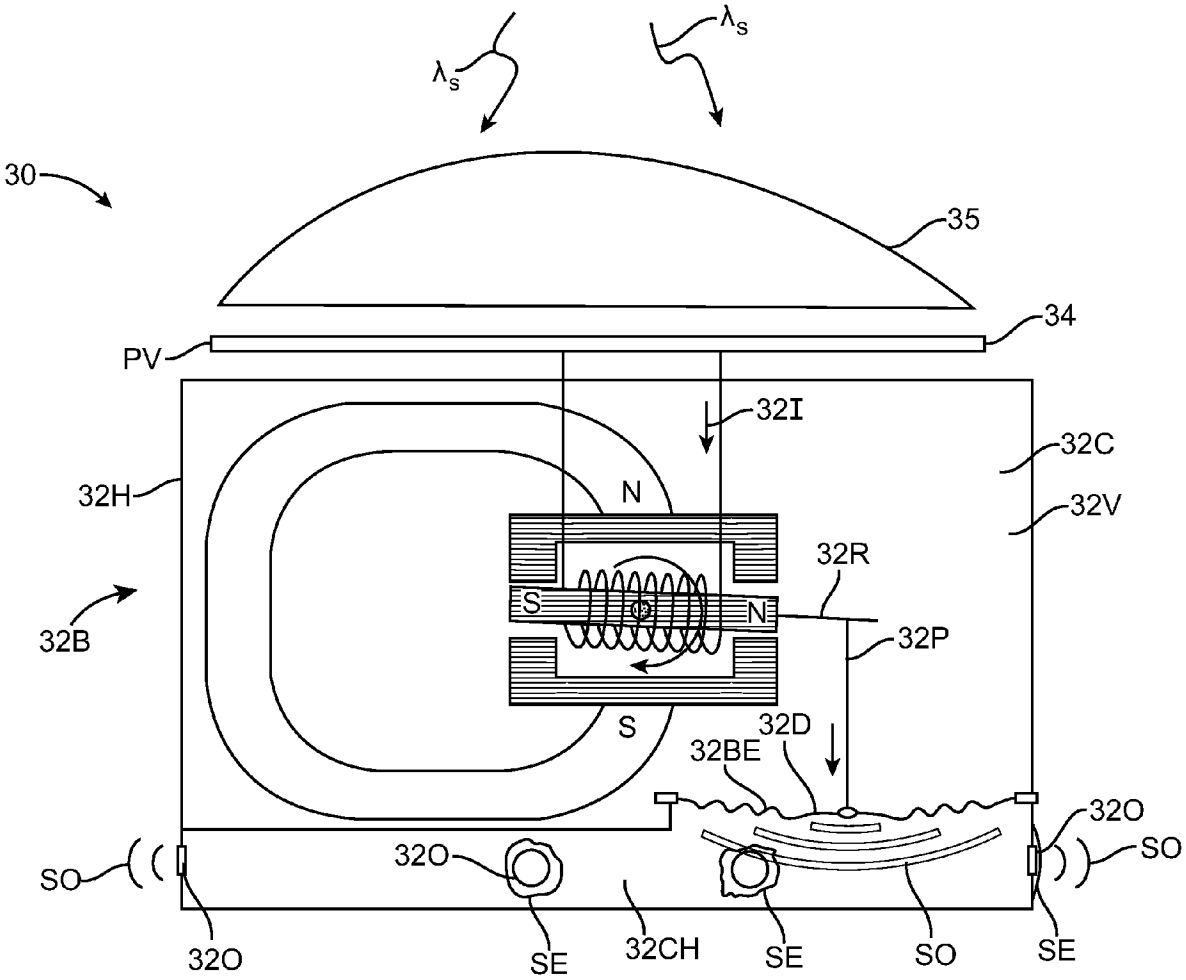
FIG. 1C5

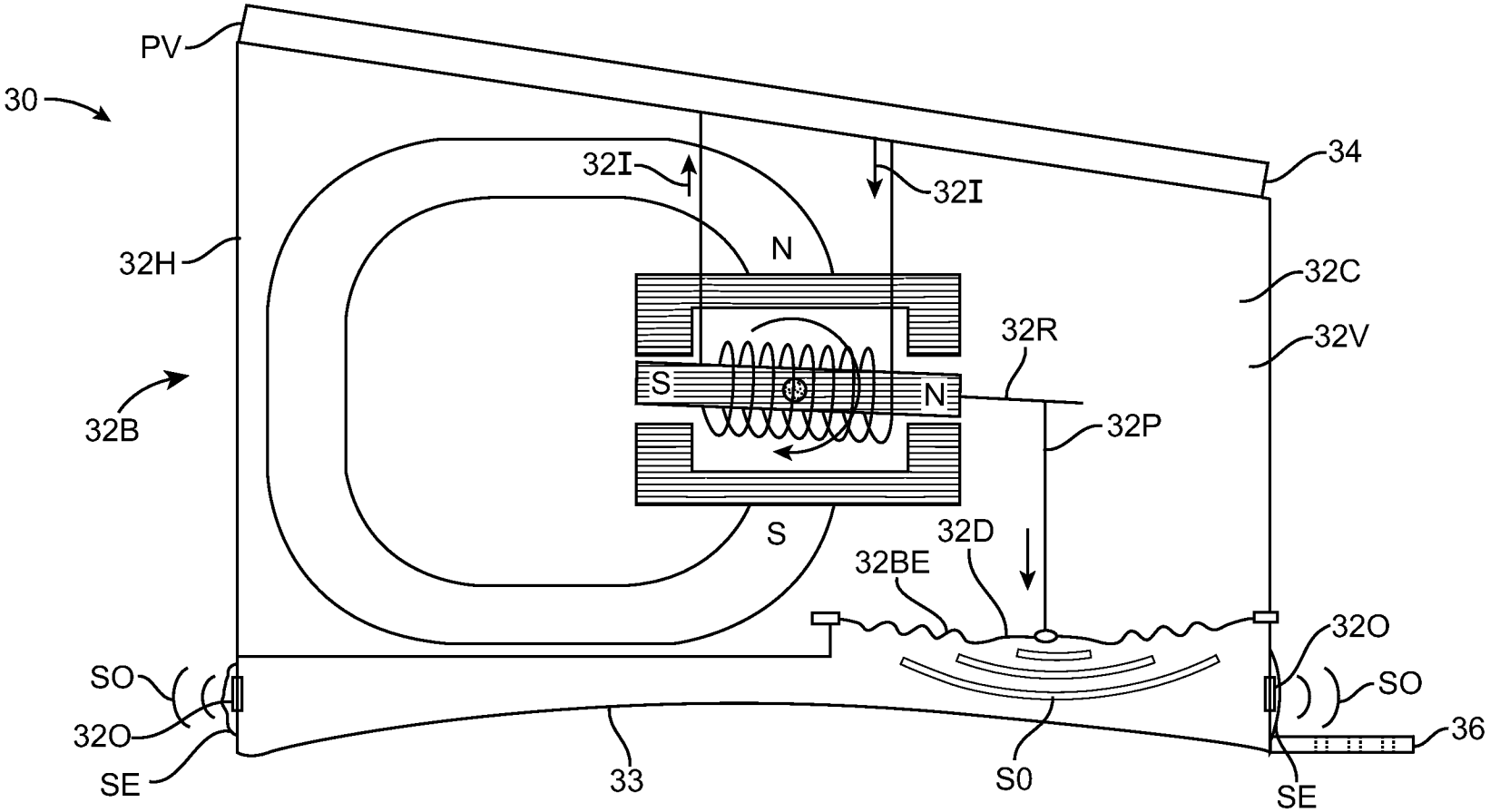
FIG. 1C6

OPTICALLY COUPLED ACOUSTIC MIDDLE EAR IMPLANT SYSTEMS AND METHODS

CROSS-REFERENCES TO RELATED APPLICATIONS

The present application claims priority to the following U.S. Applications: 61/184,563 filed 5 Jun. 2009, entitled, "Optically Coupled Acoustic Middle Ear Implant Systems and Methods"; and 61/219,286, filed 22 Jun. 2009, entitled, "Round Window Coupled Hearing Systems and Methods"; the full disclosures of which are incorporated herein by reference.

BACKGROUND OF THE INVENTION

1. Field of the Invention

The present invention is related to hearing systems, devices and methods. Although specific reference is made to hearing aid systems, embodiments of the present invention can be used in many applications in which a signal is used to stimulate the ear.

People like to hear. Hearing allows people to listen to and understand others. Natural hearing can include spatial cues that allow a user to hear a speaker, even when background noise is present. People also like to communicate with those who are far away, such as with cellular phones.

Hearing devices can be used with communication systems to help the hearing impaired and to help people communicate with others who are far away. Hearing impaired subjects need hearing aids to verbally communicate with those around them. Open canal hearing aids have proven to be successful in the marketplace because of increased comfort and an improved cosmetic appearance. Another reason why open canal hearing aides can be popular is reduced occlusion of the ear canal. Occlusion can result in an unnatural, tunnel-like hearing effect which can be caused by large hearing aids which block the ear canal. In at least some instances, occlusion be noticed by the user when he or she speaks and the occlusion results in an unnatural sound during speech. However, a problem that may occur with open canal hearing aids is feedback. The feedback may result from placement of the microphone in too close proximity with the speaker or the amplified sound being too great. Thus, feedback can limit the degree of sound amplification that a hearing aid can provide. Although feedback can be minimized by placing the microphone outside the ear canal, this placement can result in the device providing an unnatural sound that is devoid of the spatial location information cues present with natural hearing.

In some instances, feedback may be decreased by using non-acoustic means of stimulating the natural hearing transduction pathway, for example stimulating the tympanic membrane, bones of the ossicular chain and/or the cochlea. An output transducer may be placed on the eardrum, the ossicles in the middle ear, or the cochlea to stimulate the hearing pathway. However, surgery may be needed to place a hearing device on the ossicles or cochlea, and such surgery can involve delicate and complex movements to position the implant and can be somewhat invasive, for example with the cutting and drilling of bone, in at least some instances. The cutting and/or drilling of bone can delay healing and recovery time, such that implantation of at least some of the prior devices in the middle ear may not be well suited for at least some patients in at least some instances. At least some of the prior implants located on the ossicles or the cochlea can result in occlusion in at least some instances, and distortion of the sound can be perceptible in at least some instances.

One promising approach has been to place a magnet on the eardrum and drive the magnet with a coil positioned away from the eardrum. The magnet can be electromagnetically driven with a coil to cause motion in the hearing transduction pathway thereby causing neural impulses leading to the sensation of hearing. A permanent magnet may be coupled to the ear drum through the use of a fluid and surface tension, for example as described in U.S. Pat. Nos. 5,259,032 and 6,084,975. Although this approach can result in decrease feedback and shows promise, there is still room for improvement. In at least some instances, a magnet positioned on the ear may be sensitive to external electromagnetic fields that can result in a perceptible noise, for example a humming sound in at least some instances.

Another promising approach has been to optically couple a hearing device, such that noise from electromagnetic interference can be decreased. However, in at least some instances the prior systems that transmit light to a transducer can result in perceptible noise and distortion in the optically transmitted signal, such that the sound quality of such devices can be less than ideal in at least some instances. For example, at least some optical systems may comprise non-linearity that can distort the signal and may result in user-perceptible distortion in at least some instances. Work in relation to embodiments of the present invention also suggests that vibration of a photodetector can result in distortion of the transmitted signal, for example when vibration affects optical coupling from a light source to the photodetector. Also, at least some of the proposed optically coupled devices have been affixed to vibratory structures of the ear, which can result in a user perceptible occlusion due to the mass of the device affixed to the vibratory structure of the ear.

For the above reasons, it would be desirable to provide hearing systems which at least decrease, or even avoid, at least some of the above mentioned limitations of the prior hearing devices. For example, there is a need to provide a comfortable hearing device which provides hearing with natural qualities, for example with spatial information cues, and which allow the user to hear with less occlusion, distortion and feedback than prior devices.

2. Description of the Background Art

Patents and publications that may be relevant to the present application include: U.S. Pat. Nos. 3,585,416; 3,764,748; 3,882,285; 5,142,186; 5,554,096; 5,624,376; 5,795,287; 5,800,336; 5,825,122; 5,857,958; 5,859,916; 5,888,187; 5,897,486; 5,913,815; 5,949,895; 6,005,955; 6,068,590; 6,093,144; 6,139,488; 6,174,278; 6,190,305; 6,208,445; 6,217,508; 6,222,302; 6,241,767; 6,422,991; 6,475,134; 6,519,376; 6,620,110; 6,626,822; 6,676,592; 6,728,024; 6,735,318; 6,900,926; 6,920,340; 7,072,475; 7,095,981; 7,239,069; 7,289,639; D512,979; 2002/0086715; 2003/0142841; 2004/0234092; 2005/0020873; 2006/0107744; 2006/0233398; 2006/075175; 2007/0083078; 2007/0191673; 2008/0021518; 2008/0107292; commonly owned U.S. Pat. No. 5,259,032; U.S. Pat. No. 5,276,910; U.S. Pat. No. 5,425,104; U.S. Pat. No. 5,804,109; U.S. Pat. No. 6,084,975; U.S. Pat. No. 6,554,761; U.S. Pat. No. 6,629,922; U.S. Publication Nos. 2006/0023908; 2006/0189841; 2006/0251278; and 2007/0100197. Non-U.S. patents and publications that may be relevant include EP1845919 PCT Publication Nos. WO 03/063542; WO 2006/075175; U.S. Publication Nos. Journal publications that may be relevant include: Ayatollahi et al., "Design and Modeling of Micromachines Condenser MEMS Loudspeaker using Permanent Magnet Neodymium-Iron-Boron (Nd—Fe—B)", ISCE, Kuala Lampur, 2006; Birch et al, "Microengineered Systems for the Hearing Impaired", IEE, London, 1996; Cheng et al., "A silicon microspeaker for hearing instruments", J. Micromech. Microeng., 14(2004) 859-866; Yi et al., "Piezoelectric microspeaker with compressive nitride diaphragm", IEEE, 2006, and Zhigang Wang et al., "Preliminary Assessment of Remote Photoelectric Excitation of an Actuator for a Hearing Implant", IEEE Engineering in Medicine and Biology 27th Annual Conference, Shanghai, China, Sep. 1-4, 2005. Other publications of interest include: Gennum GA3280 Preliminary Data Sheet, "Voyager TDTM. Open Platform DSP System for Ultra Low Power Audio Processing" and National Semiconductor LM4673 Data Sheet, "LM4673 Filterless, 2.65 W, Mono, Class D audio Power Amplifier"; Puria, S. et al., Middle ear morphometry from cadaveric temporal bone micro CT imaging, Invited Talk. MEMRO 2006, Zurich; Puria, S. et al, A gear in the middle ear ARO 2007, Baltimore, Md.; O'Connor, K. and Puria, S. "Middle ear cavity and ear canal pressure-driven stapes velocity responses in human cadaveric temporal bones" *J. Acoust. Soc. Am.* 120(3) 1517-1528.

BRIEF SUMMARY OF THE INVENTION

The present invention is related to hearing systems, devices and methods. Although specific reference is made to hearing aid systems, embodiments of the present invention can be used in many applications in which a signal is used to transmit sound to a user, for example cellular communication and entertainment systems.

Embodiments of the present invention can provide improved hearing so as to overcome at least some of the aforementioned limitations of prior systems. The hearing device may comprise an assembly that can be implanted in the middle ear in a manner that simplifies surgery. The assembly may comprise a narrow cross-sectional profile such that the assembly can be positioned in the middle ear cavity through an incision in the eardrum, for example without cutting bone such as drilling through bone. The incision can be closed, such that the recovery time can be decreased substantially and such that until functional hearing and comfort can be provided with the implanted device about one day after surgery. In at least some embodiments, the person can hear and use the device implanted in the middle ear about one day after to surgery. Electromagnetic energy can be transmitted through the eardrum to a transducer configured to vibrate the ear in response to the electromagnetic energy. In many embodiments, the sound transducer comprises a speaker positioned in the middle ear cavity, and the sound transducer can couple to vibratory structure of the ear with air so as to simplify surgery and positioning of the assembly. A microphone can be positioned in the ear canal, or near the pinna, with reduced feed back as the eardrum is disposed between the speaker and the microphone. The assembly may be supported, for example affixed, to a substantially fixed structure of the ear, for example the promontory, so as to inhibit user perceivable occlusion and inhibit motion of the assembly, such that the user can perceive clear sound with little occlusion and little distortion.

The assembly can be sized for passage through the incision and placement in the middle ear cavity on the promontory with a photodetector oriented toward a posterior portion of the eardrum. For example, the assembly may have a first surface comprising a photodetector such as a photovoltaic to detect light and a second concavely shaped surface to receive a portion of the promontory, in which the second surface is disposed opposite the first surface such that the first surface is oriented toward the eardrum when the second surface receives the portion of the promontory. The first surface comprising the photodetector can be inclined relative to the second concavely shaped surface, such that a first portion of the assembly comprises a first thickness extending between the first surface and the second surface and a second portion comprises a second thickness extending between the first surface and the second surface. The first thickness can be less than the second thickness such that first portion can be placed toward the umbo and the second portion can be placed toward a posterior portion of the annulus when the assembly is positioned on a posterior portion of the middle ear cavity. The transducer, for example a permanent magnet of a balanced armature transducer, can be disposed in the second portion between the first surface and the second surface, and a diaphragm can be disposed in the first portion between the first surface and the second surface and coupled to transducer, for example with a post extending to a reed of the balanced armature transducer.

In a first aspect, embodiments of the present invention provide a device to transmit sound to an ear of a user, in which the ear comprises a middle ear and an eardrum. The device comprises an assembly configured to couple to a tissue of a middle ear of a user. The assembly comprises at least one transducer configured to receive electromagnetic energy transmitted through the eardrum. A sound transducer is coupled to the at least one transducer and configured to transmit the sound to the user in response to the electromagnetic energy when the assembly is supported with the tissue of the middle ear of the user. The assembly can be supported in the middle ear cavity with one or more of many types of tissue of the middle ear such as fascia tissue, autograft tissue, connective tissue, or bony tissue of the promontory, In many embodiments, the sound transducer comprises a speaker. The sound transducer may comprise a diaphragm configured to vibrate and displace air to transmit the sound to the user. The assembly further may comprises a housing extending at least partially around the transducer comprising the diaphragm to define a chamber within the assembly. The chamber may comprise a volume, and the transducer can be configured to increase the volume to increase an air pressure of the middle ear and to decrease to volume to decrease the air pressure of the middle ear so as to transmit the sound to the user. For example, the diaphragm can be configured to move away from chamber to increase the volume of the chamber and to move toward the chamber to decrease the volume of the chamber. The chamber may comprise a sealed chamber so as to inhibit air flow in and out of the chamber when the diaphragm moves.

In many embodiments, the assembly comprises an anchoring structure configured to anchor the assembly to a substantially fixed tissue of the middle ear of the user. The anchoring structure may comprise at least one of a flange, a surface coating or holes configured to receive tissue, for example an autograft of tissue, so as to affix the assembly to the substantially fixed tissue of the middle ear. The substantially fixed tissue of the middle ear may comprise at least one of a promontory or a round window niche. The substantially fixed tissue of the middle ear may comprise the promontory, and the assembly may comprise a concave portion shaped to receive a portion of the promontory. Alternatively or in combination, the substantially fixed tissue of the middle ear may comprise the round window niche, and at least a portion of the assembly is sized to fit within the round window niche. The at least the portion of the assembly sized to fit within the round window niche may comprise a maximum cross sectional dimension across of no more than about 3 mm.

In many embodiments, the portion of the assembly sized to fit in the round window niche is configured to couple to the round window with air. The transducer can be configured to transmit a first majority of the sound comprising the first frequencies to the user with the eardrum and to transmit a second majority of the sound comprising the second frequencies to the user with the round window. For example, the portion sized to fit in the round window nice can be configured to couple substantially to the eardrum with first frequencies below about 4 kHz and to couple substantially to the round window with frequencies above about 5 kHz, for example about 10 kHz.

In many embodiments, the sound transducer is configured to couple to couple to a vibratory structure of the ear when the assembly is affixed to the substantially fixed tissue. The vibratory structure of the ear may comprise at least one of an eardrum, an ossicle or a round window.

In many embodiments, the sound transducer is configured to couple to at least one of an eardrum or a round window of the ear of the user with a fluid. For example, the fluid may comprise air and the sound transducer may be configured to couple to the eardrum of the user with the sound transducer oriented away from the eardrum. The sound transducer can be configured to couple to the round window, and the assembly may be sized to fit at least partially within of a round window niche of the middle ear of the user to couple the sound transducer to the round window.

In many embodiments, the sound transducer comprises an extension sized to fit within the round window niche to couple to the round window with a fluid. The fluid may comprise air, and the sound transducer can be configured to couple to the round window with the air extending between the sound transducer and the round window. For example, the extension may comprise a channel extending from a diaphragm to an opening, in which the opening is positioned on the extension to orient toward the round window when the assembly is supported with the tissue of the middle ear. The diaphragm may comprises a first cross sectional area of the channel and the opening may comprise a second cross sectional area of the channel, in which the first area is at least about five times the second area to concentrate sound energy at the opening oriented toward the round window The fluid comprises a liquid, and the sound transducer can be configured to couple to the round window with the liquid extending between the sound transducer and the round window.

In many embodiments, the at least one transducer comprises at least one of a photodetector or a coil, and the at least one transducer oriented to receive the electromagnetic radiation transmitted through the eardrum. The at least one transducer may comprise the photodetector, and the photodetector may comprise a first photodetector sensitive to a first at least one wavelength of light and a second photodetector sensitive to a second at least one wavelength of light, in which the first at least one wavelength of light is different from the second at least one wavelength of light. The photodetector may comprise a photovoltaic cell, for example a photodiode.

In many embodiments, the sound transducer comprises at least one of a balanced armature transducer, a coil or a magnet.

In many embodiments, an emitter configured to emit the electromagnetic radiation through the eardrum. The emitter may comprise at least one of an LED, a laser diode or a coil. The emitter can be configured for placement within an ear canal of the user. Alternatively or in combination, the emitter can be coupled to a waveguide, in which the waveguide is configured for placement at least partially within the ear canal of the user so as to couple the emitter to the at least one transducer.

In many embodiments, a first microphone configured for placement in an ear canal or the user or near an ear canal opening to detect high frequency sound localization cues having frequencies above at least about 4 kHz. A second microphone can be configured for placement away from in the ear canal and the ear canal opening to detect low frequency sound having frequencies below about 5 kHz, for example below about 4 kHz, which may decrease feedback from the sound transducer positioned in the middle ear.

In many embodiments, the at least one transducer comprises a photodetector having a first surface to receive light, and the assembly comprises a second concave surface to receive a portion of a promontory of the middle ear, in which the first surface is opposite the second surface. The sound transducer is disposed between the first surface and the second concave surface. The first surface can be inclined relative to the second surface, and a first portion of the assembly may comprise a first thickness extending between the first surface and the second surface. A second portion of the assembly may comprise a second thickness extending between the first surface and the second surface, in which the first thickness is less than the second thickness. The sound transducer may comprise a balanced armature transducer having a coil, a permanent magnet and a reed, in which the reed is coupled to a diaphragm. The diaphragm can be disposed on the first portion between the first surface and the second surface and the permanent magnet disposed on the second portion between the first surface and the second surface.

In many embodiments, at least one lens is positioned on the first surface to couple optically to at least a portion of the eardrum and transmit light scattered from the eardrum to the first surface.

In another aspect, embodiments of the present invention provide method of transmitting sound to an ear of a user, the ear having an eardrum and a middle ear. Electromagnetic energy is transmitted through the eardrum to a transducer configured to receive the electromagnetic energy. Sound is emitted from a sound transducer positioned in the middle ear so as to transmit the sound to the ear of the user in response to the electromagnetic energy.

In many embodiments, the sound transducer is affixed to a fixed structure of the middle ear and coupled with a fluid to a vibratory structure of the ear. The fixed structure may comprise at least one of a promontory of the middle ear or a round window niche of the middle ear. The sound transducer can be affixed to the fixed structure, for example with an autograft composed of tissue of the user. The vibratory structure may comprise at least one of the eardrum, an ossicle or a round window of the ear.

In many embodiments, at least a portion of the assembly is positioned within a round window niche of the middle ear of the user. The sound transducer is coupled to a round window of an inner ear of the ear with a fluid disposed between the sound transducer and the round window. The fluid may comprise air, and the sound transducer can be oriented toward the round window to couple the sound transducer to the round window. The fluid may comprise a liquid, and the liquid may extend from at least a portion of the round window to the sound transducer so as to couple the sound transducer to the round window. Such coupling with fluid comprising a gas or a liquid, can couple the sound transducer to the ear with minimal occlusion, as the vibratory structures of the ear can vibrate with minimal damping due to the mass of the assembly. A volume of the liquid extending from the sound transducer to the round window may comprises no more than about 50 uL, for example no more than about 20 uL.

In many embodiments, at least a portion of the assembly is supported with a promontory of the middle ear. The sound transducer can be coupled with air to at least one of the eardrum or a round window of the ear. For example, the sound transducer can be coupled with air to the eardrum and the sound transducer can be oriented away from the eardrum to couple the sound transducer to the eardrum of the user.

In many embodiments, the electromagnetic radiation comprises light energy. The light energy may comprise at least one of ultraviolet light, visible light or infrared light.

In many embodiments, the electromagnetic energy is received by a transducer oriented toward the eardrum to receive the electromagnetic energy and wherein the transducer is coupled to the sound transducer such that the sound transducer emits the sound in response to the electromagnetic energy.

In many embodiments, at least a first microphone is positioned in an ear canal or near an opening of the ear canal to measure high frequency sound above at least about one 4 kHz comprising spatial localization cues. A second microphone can be positioned away from the ear canal and the ear canal opening to measure at least low frequency sound below about 4 kHz. The sound from the first microphone may be transmitted to the user substantially with the eardrum and sound from the second microphone may be transmitted to the user substantially with the round window so as to inhibit feedback.

In many embodiments, the sound transducer comprises an inner chamber having a volume, and the volume decreases to decrease an air pressure of the middle ear and increase to increase the air pressure of the middle ear to transmit the sound to the user.

In another aspect, embodiments of the present invention provide a device to transmit sound to an ear of a user, in which the ear comprises a middle ear. The device comprises an assembly configured for placement in the middle ear of the user. The assembly comprises at least one photo detector, and a structure to affix the assembly to a substantially fixed tissue of the middle ear. A speaker is coupled to the at least one photodetector and configured to transmit the sound to the user when the assembly is affixed the substantially fixed tissue of the middle ear.

In another aspect, embodiments of the present invention provide a device to transmit sound to an ear of a user. The device comprises means for transmitting the sound to the ear of the user.

In another aspect, embodiments of the present invention provide method of placing a hearing assembly in a middle ear of a user, in which the ear has an eardrum. An incision is formed in eardrum. The assembly is passed through the incision to position the assembly in the middle ear. The assembly is affixed to a substantially fixed to tissue of the middle ear. The incision is closed such that the eardrum heals.

In many embodiments, the incision in the eardrum extends around an outer portion of the eardrum. The eardrum may comprise an annulus, and the incision can extend at least partially into the annulus, for example at least partially around the annulus.

In many embodiments, the hearing assembly is sized to pass through the incision without cutting bone, for example without drilling bone, and the hearing assembly is coupled to vibratory structures of the ear with a fluid such that occlusion is inhibited.

BRIEF DESCRIPTION OF THE DRAWINGS

FIG. 1C1 shows an output transducer assembly comprising a balanced armature transducer coupled to a diaphragm oriented toward a round window of the middle ear and at least one photodetector oriented toward the eardrum of the middle ear, in accordance with the embodiments of the present invention;

FIG. 1C2 shows output transducer assembly comprising a portion sized to fit in the round window niche, in accordance with embodiments;

FIG. 1C3 shows an input transducer assembly comprising an optical fiber and collimation optics coupled to an output transducer assembly having a convexly curved photodetector to receive light scattered from the tympanic membrane and a concavely curved surface to receive a portion of the promontory, in accordance with embodiments;

FIG. 1C4 shows an input transducer assembly comprising an optical fiber and collimation optics coupled to an output transducer assembly having a convexly curved lens disposed on a photodetector to receive light scattered from the tympanic membrane and a concavely curved surface to receive a portion of the promontory, in accordance with embodiments;

FIG. 1C5 shows an output transducer assembly comprising a balanced armature transducer disposed between a photodetector to receive light scattered from the tympanic membrane and a concavely curved surface to receive a portion of the promontory, in accordance with embodiments;

FIG. 1C6 shows an output transducer assembly comprising a balanced armature transducer disposed between a photodetector to receive light scattered from the tympanic membrane and a concavely curved surface to receive a portion of the promontory, in which a surface of the photodetector is inclined relative to the balanced armature transducer and concavely curved surface, in accordance with embodiments;

FIG. 2 shows the frequency response of the cochlea to the transducer assembly and the contribution of the eardrum and round window, in accordance to embodiments; and FIG. 3 shows an experimental setup to measure optical transmission through the tympanic membrane, in accordance to embodiments.

DETAILED DESCRIPTION OF THE INVENTION

Embodiments of the present invention are well suited to improve communication among people, for example with cellular communication and as a hearing aid with an implantable component with decreased invasiveness that can be readily implanted by a health care provider. As the implantable device can be positioned in the middle ear cavity with an incision in a portion of the eardrum, the surgery can be minimally invasive. Also, as bone may not be cut and the device can work without contacting the moving structures of the ear such as tympanic membrane and ossicles, the implant can be removed such that the surgery is reversible and has a low risk of complications for the patient. As the device can be readily implanted with soft tissue, for example fascia, on the promontory, the implantable device as described herein can be used with individuals with normal hearing and with hearing impaired individuals.

As used herein, light encompasses electromagnetic radiation having wavelengths within the visible, infrared and ultraviolet regions of the electromagnetic spectrum.

In many embodiments, the hearing device comprises a photonic hearing device, in which sound is transmitted with photons having energy, such that the signal transmitted to the ear can be encoded with transmitted light.

As used herein, an emitter encompasses a source that radiates electromagnetic radiation and a light emitter encompasses a light source that emits light.

As used herein like references numerals and letters indicate similar elements having similar structure, function and methods of use.

Figure 1:
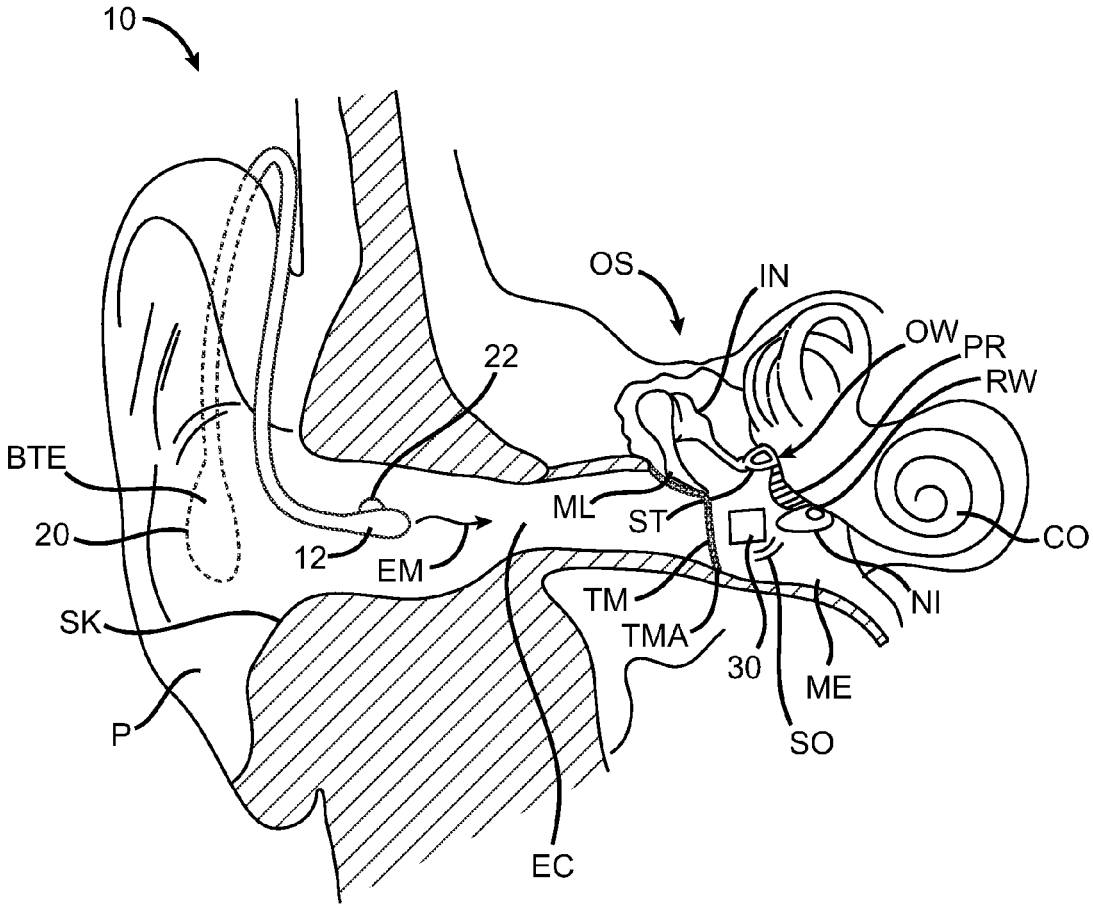
FIG. 1 shows a hearing aid system configured to transmit electromagnetic energy to an output transducer assembly comprising speaker positioned in the middle ear cavity, in accordance with embodiments of the present invention.

FIG. 1 shows a hearing aid system 10 configured to transmit electromagnetic energy to a speaker assembly 30 positioned in the middle ear ME of the user. The ear comprises an external ear, a middle ear ME and an inner ear. The external ear comprises a Pinna P and an ear canal EC and is bounded medially by an eardrum TM. Ear canal EC extends medially from pinna P to eardrum TM. Ear canal EC is at least partially defined by a skin SK disposed along the surface of the ear canal. The eardrum TM comprises an annulus TMA that extends circumferentially around a majority of the eardrum to hold the eardrum in place. The middle ear ME is disposed between eardrum TM of the ear and a cochlea CO of the ear. The middle ear ME comprises the ossicles OS to couple the eardrum TM to cochlea CO. The ossicles OS comprise an incus IN, a malleus ML and a stapes ST. The malleus ML is connected to the eardrum TM and the stapes ST is connected to an oval window OW, with the incus IN disposed between the malleus ML and stapes ST. Stapes ST is coupled to the oval window OW so as to conduct sound from the middle ear to the cochlea.

The hearing system 10 includes an input transducer assembly 20 and an output transducer assembly 30 to transmit sound to the user. Hearing system 10 may comprise a behind the ear unit BTE. Behind the ear unit BTE may comprise many components of system 10 such as a speech processor, battery, wireless transmission circuitry and input transducer assembly 10. Behind the ear unit BTE may comprise many component as described in U.S. Pat. Pub. Nos. 2007/0100197, entitled "Output transducers for hearing systems"; and 2006/0251278, entitled "Hearing system having improved high frequency response", the full disclosures of which are incorporated herein by reference and may be suitable for combination in accordance with some embodiments of the present invention. The input transducer assembly 20 can be located at least partially behind the pinna P, although the input transducer assembly may be located at many sites. For example, the input transducer assembly may be located substantially within the ear canal, as described in U.S. Pub. No. 2006/0251278, the full disclosure of which is incorporated by reference. The input transducer assembly may comprise a blue tooth connection to couple to a cell phone and my comprise, for example, components of the commercially available Sound ID 300, available from Sound ID of Palo Alto, Calif.

The input transducer assembly 20 can receive a sound input, for example an audio sound. With hearing aids for hearing impaired individuals, the input can be ambient sound. The input transducer assembly comprises at least one input transducer, for example a microphone 22. Microphone 22 can be positioned in many locations such as behind the ear, as appropriate. Microphone 22 is shown positioned to detect spatial localization cues from the ambient sound, such that the user can determine where a speaker is located based on the transmitted sound. The pinna P of the ear can diffract sound waves toward the ear canal opening such that sound localization cues can be detected with frequencies above at least about 4 kHz. The sound localization cues can be detected when the microphone is positioned within ear canal EC and also when the microphone is positioned outside the ear canal EC and within about 5 mm of the ear canal opening. The at least one input transducer may comprise a second microphone located away from the ear canal and the ear canal opening, for example positioned on the behind the ear unit BTE. The input transducer assembly can include a suitable amplifier or other electronic interface. In some embodiments, the input may comprise an electronic sound signal from a sound producing or receiving device, such as a telephone, a cellular telephone, a Bluetooth connection, a radio, a digital audio unit, and the like.

In many embodiments, at least a first microphone can be positioned in an ear canal or near an opening of the ear canal to measure high frequency sound above at least about one 4 kHz comprising spatial localization cues. A second microphone can be positioned away from the ear canal and the ear canal opening to measure at least low frequency sound below about 4 kHz. This configuration may decrease feedback to the user, as described in U.S. Pat. Pub. No. US 2009/0097681, the full disclosure of which is incorporated herein by reference and may be suitable for combination in accordance with embodiments of the present invention.

Input transducer assembly 20 includes a signal output source 12 which may comprise a light source such as an LED or a laser diode, an electromagnet, an RF source, or the like. The signal output source can produce an output based on the sound input. Implantable output transducer assembly 30 can receive the output from input transducer assembly 20 and can produce mechanical vibrations in response. Implantable output transducer assembly 30 comprises a sound transducer and may comprise at least one of a coil, a magnet, a magnetostrictive element, a photostrictive element, or a piezoelectric element, for example. For example, the implantable output transducer assembly 30 can be coupled an input transducer assembly 20 comprising an elongate flexible support having a coil supported thereon for insertion into the ear canal as described in U.S. Pat. Pub. No. 2009/0092271, entitled "Energy Delivery and Microphone Placement Methods for Improved Comfort in an Open Canal Hearing Aid", the full disclosure of which is incorporated herein by reference and may be suitable for combination in accordance with some embodiments of the present invention. Alternatively or in combination, the input transducer assembly 20 may comprise a light source coupled to a fiber optic, for example as described in U.S. Pat. Pub. No. 2006/0189841 entitled, "Systems and Methods for Photo-Mechanical Hearing Transduction", the full disclosure of which is incorporated herein by reference and may be suitable for combination in accordance with some embodiments of the present invention. The light source of the input transducer assembly 20 may also be positioned in the ear canal, and the output transducer assembly and the BTE circuitry components may be located within the ear canal so as to fit within the ear canal. When properly coupled to the subject's hearing transduction pathway, the mechanical vibrations caused by output transducer 30 can induce neural impulses in the subject which can be interpreted by the subject as the original sound input.

The implantable output transducer assembly 30 can be configured to couple to the hearing transduction pathway of the middle ear in many ways, so as to induce neural impulses which can be interpreted as sound by the user. The coupling may occur with a fluid disposed in the ear, such as air, which can couple the speaker to a vibratory structure of the ear. The fluid may also comprise a liquid, so as to couple the speaker a tissue of the middle ear. The output transducer assembly 30 positioned in the middle ear cavity can emit sound from a sound transducer, such as speaker. The implantable output transducer assembly 30 can be supported with a substantially fixed structure of the ear, such that vibration of the vibratory structures of the ear is not inhibited by mass of assembly 30. For example, output transducer assembly 30 may be supported on the promontory PM by a support, housing, mold, or the like shaped to conform with the shape of the promontory PM. The transducer assembly may be affixed with a tissue graft to skin supported with rigid bony structure that defines at least a portion of the ear canal. The transducer assembly 30 can be supported with many of the additional substantially fixed structures of the middle ear such as the bone that defines the round window niche.

Implantable output transducer assembly 30 can cause the vibratory structures of the ear to vibrate in response to the sound waves transmitted by the sound transducer in many ways. For example, sound waves emitted by the sound transducer of the assembly disposed within the middle ear cavity can cause eardrum TM to vibrate and transmit sound to the cochlea CO. The sound transducer can increase and decrease air pressure within the middle ear so as to drive the eardrum outward and inward, respectively, such that the user perceives sound. For example, the sound transducer may comprise a diaphragm that moves outward to increase sound pressure of the middle ear and inward to decrease the sound pressure of the middle ear. The sound transducer may comprise an inner chamber comprising a volume, and outward movement of the diaphragm can increase the volume of the inner chamber and pressure of the middle ear, and inward movement of the diaphragm can decrease the volume of the inner chamber and pressure of the middle ear. As the change in pressure can result from a change in volume of inner chamber of the sound transducer, the sound transducer can couple to the eardrum in many orientations, for example even when the sound transducer is orientated away from the eardrum. This low sensitivity of the coupling in relation to the orientation of the transducer assembly can substantially facilitate successful surgical implantation of the assembly.

The sound pressure emitted by the sound transducer 30 coupled to the Eardrum TM. Eardrum TM is coupled to the cochlea CO with ossicles OS disposed there between in the middle ear, such that vibration of eardrum TM transmits sound to cochlea CO with vibration of the ossicles. The ossicles OS comprise a Malleus ML, an incus IN, and a stapes ST, and vibrate so as to couple the eardrum TM to the cochlea. The stapes is ST is coupled to the cochlea through an oval window OW so as to transmit sound from the stapes to cochlea with vibration of the stapes. The oval window OW comprises a membrane-covered opening which leads from the middle ear to the vestibule of the inner ear, so as to vibrate and transmit sound from the stapes to the cochlea CO. The round window RW comprises membrane-covered opening disposed between the inner ear and the middle ear. The round window RW can vibrate in response to sound transmitted from the stapes through the oval window to the cochlea, so as to release pressure from sound waves and decrease acoustic impedance of the other vibratory structures coupled to the cochlea.

Figure 1A:
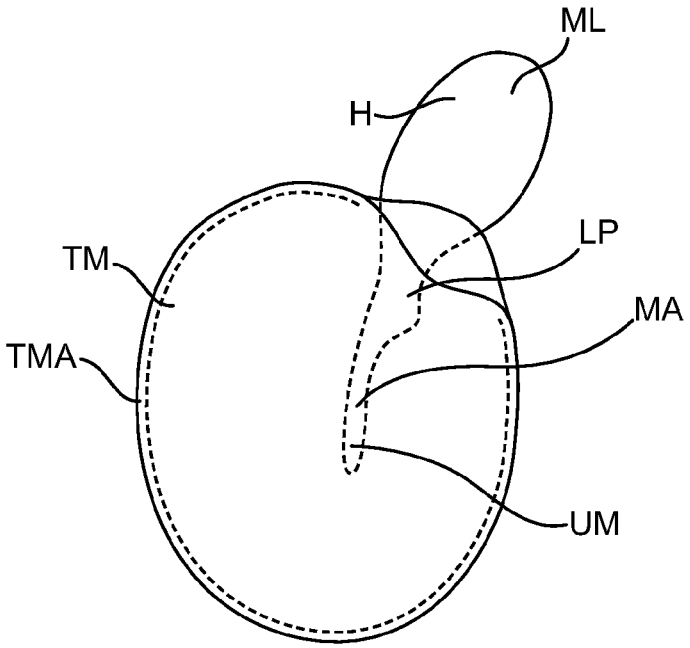
FIG. 1A shows the lateral side of the eardrum from a medial view and FIG. 1B shows the medial side of the eardrum from a lateral view, suitable for incorporation of the hearing aid system of FIG. 1.
Figure 1B:
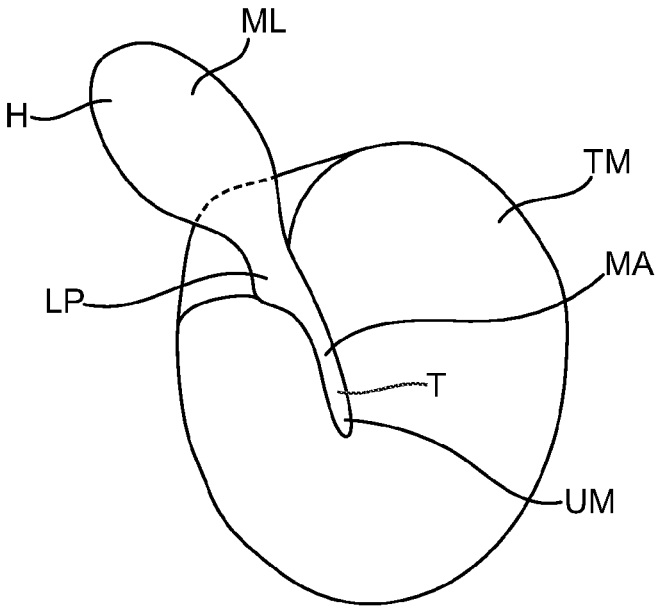

FIG. 1A shows structures of the ear on the lateral side of the eardrum TM from a medial view, and FIG. 1B shows structures of the ear on the medial side of the eardrum TM from a lateral view. The eardrum TM is connected to a malleus ML. The eardrum TM comprises annulus TMA that extends circumferentially around a majority of eardrum TM. In at least some embodiments, and incision can be formed in annulus TMA and an inner portion of eardrum TM, such that a flap of eardrum can be pushed to the side to access the middle ear ME. Malleus ML comprises a head H, a manubrium MA, a lateral process LP, and a tip T. Manubrium MA is disposed between head H and tip T and coupled to eardrum TM, such that the malleus ML vibrates with vibration of eardrum TM.

Figure 1C:
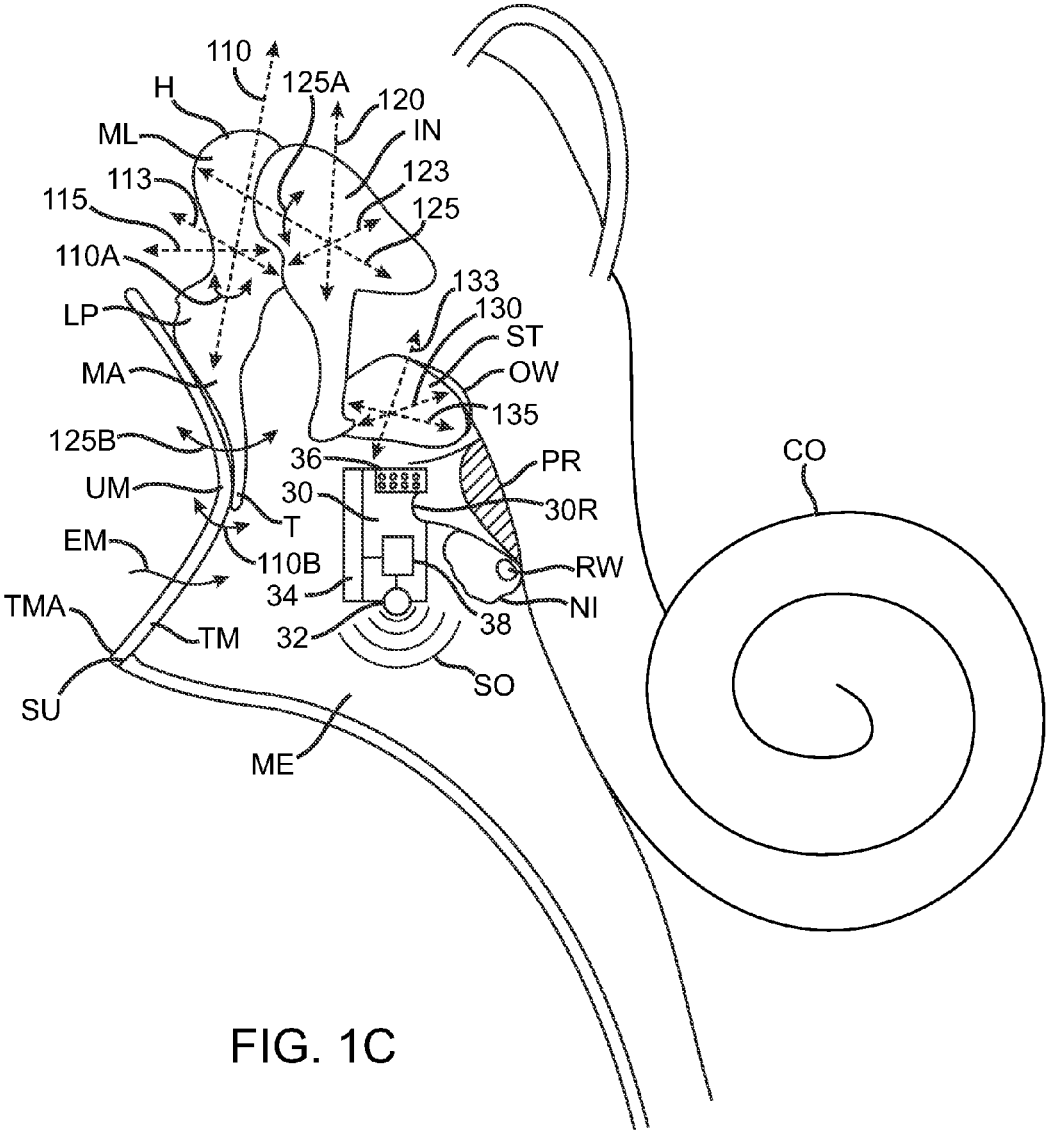
FIG. 1C shows the hearing conduction pathway and with the output transducer assembly comprising a speaker as in FIG. 1 affixed to the promontory of the middle ear, in accordance with the embodiments of the present invention.

FIG. 1C shows the output transducer assembly 30 affixed to the promontory disposed on an inner surface of the cavity of the middle ear ME, such that the user can perceive sound. Output transducer assembly 30 comprises a sound transducer 32. Sound transducer 32 emits sound pressure SO from the middle ear that is perceived by the user. The output transducer assembly also comprises at least one transducer 34 configured to receive electromagnetic energy transmitted through the eardrum TM, for example at least one of a coil, a photodetector, or a photostrictive material. The at least one transducer 34 may be coupled to the sound transducer 32 with circuitry 38, such that sound is emitted from the speaker in response to electromagnetic energy transmitted through eardrum TM. Output transducer assembly 30 may comprise an anchor structure 36 configured to affix the output transducer assembly to a substantially fixed structure of the ear, such as promontory PR. The anchor structure 36 may comprise a biocompatible structure configured to receive a tissue graft, for example, and may comprise at least one of a coating, a flange or holes for tissue integration. The anchor structure 36 can be affixed to tissue such that the location of the assembly remains substantially fixed, either when sound transducer 32 is acoustically coupled to the vibratory structures of the ear, or due to head movements, or both.

The sound emitted by sound transducer 32 can induce vibration of the vibratory components of the hearing conduction pathway such that the user perceives sound. The sound pressure SO emitted from sound transducer 32 can induce vibration of the eardrum TM. Eardrum TM is coupled to the ossicles including the malleus ML, incus IN, and stapes ST. The manubrium MA of the malleus ML can be firmly attached to eardrum TM. The most depressed or concaved point of the eardrum TM comprises the umbo UM. Malleus ML comprises a first axis 110, a second axis 113 and a third axis 115. Incus IN comprises a first axis 120, a second axis 123 and a third axis 125. Stapes ST comprises a first axis 130, a second axis 133 and a third axis 135.

The axes of the malleus ML, incus IN and stapes ST can be defined based on moments of inertia. The first axis may comprise a minimum moment of inertia for each bone. The second axis comprises a maximum moment of inertia for each bone. The first axis can be orthogonal to the second axis. The third axis extends between the first and second axes, for example such that the first, second and third axes comprise a right handed triple. For example first axis 110 of malleus ML may comprise the minimum moment of inertia of the malleus. Second axis 113 of malleus ML may comprise the maximum moment of inertia of malleus ML. Third axis 115 of malleus ML can extend perpendicular to the first and second axis, for example as the third component of a right handed triple defined by first axis 110 and second axis 113. Further first axis 120 of incus IN may comprise the minimum moment of inertia of the incus. Second axis 123 of incus IN may comprise the maximum moment of inertia of incus IN. Third axis 125 of incus IN can extend perpendicular to the first and second axis, for example as the third component of a right handed triple defined by first axis 120 and second axis 123. First axis 130 of stapes ST may comprise the minimum moment of inertia of the stapes. Second axis 133 of stapes ST may comprise the maximum moment of inertia of stapes ST. Third axis 135 of stapes ST can extend perpendicular to the first and second axis, for example as the third component of a right handed triple defined by first axis 130 and second axis 133.

Vibration of the output transducer system can induce vibration of eardrum TM and malleus ML that is transmitted to stapes ST via Incus IN, such that the user perceives sound. Low frequency vibration of eardrum TM at umbo UM can cause hinged rotational movement 125A of malleus ML and incus IN about axis 125. Translation at umbo UM and causes a hinged rotational movement 125B of the tip T of malleus ML and hinged rotational movement 125A of malleus ML and incus IN about axis 125, which causes the stapes to translate along axis 135 and transmits vibration to the cochlea. Vibration of eardrum TM, for example at higher frequencies, may also cause malleus ML to twist about elongate first malleus axis 110 in a twisting movement 110A. Such twisting may comprise twisting movement 110B on the tip T of the malleus ML. The twisting of malleus ML about first malleus axis 110 may cause the incus IN to twist about first incus axis 120. Such rotation of the incus can cause the stapes to transmit the vibration to the cochlea where the vibration is perceived as sound by the user.

The output transducer assembly and anchor structure can be shaped in many ways to fit within the middle ear and affix to structures therein. For example, the transducer assembly may comprise a cross sectional size to pass through an incision in the eardrum TM and annulus TMA, such that bone that defines the ear canal can remain intact. The annulus TMA can be supported by a sulcus SU formed in the bony portion of the ear disposed between the external ear and middle ear. The eardrum can be incised along the annulus to form a flap of eardrum, a portion of which eardrum may remain connected to the user and placed on the margin of the ear canal when the transducer assembly 30 is positioned in the middle ear. Flap can be positioned after the transducer is positioned in the middle ear. The transducer assembly may comprise at least a portion shaped to fit within a round window niche. Alternatively or in combination, transducer assembly 30 may comprise a rounded concave portion 30R shaped to receive a rounded promontory of the middle ear.

With the output transducer assembly positioned in the middle ear, the combined mass of the output transducer assembly components can be at least about 50 mg, for example 100 mg or more, and have a minimal effect on occlusion perceived by the user as the output transducer assembly is affixed to substantially fixed structures of the middle ear, such that the vibratory structures comprising the eardrum, ossicles, round window and oval window are substantially free to vibrate.

The sound transducer 32 may comprise known speaker components sized to fit within the middle ear and sized to fit though an incision of the eardrum TM. For example, the speaker may comprise at least one of a balanced armature transducer, a coil, a magnet, a piezoelectric transducer, or a photostrictive material.

The implantable output transducer assembly 30 can be configured in many ways to produce sound pressure SO in response to the electromagnetic energy, such that the assembly can be positioned in the middle with an incision in the eardrum TM comprising annulus TMA, for example without cutting bone and without drilling bone. For example, the assembly 30 may comprise a first photodetector configured to receive a first at least one wavelength of light and a second photodetector configured to receive a second at least one wavelength of light, in which the assembly is configured to increase the volume of an internal chamber and increase the pressure of the middle ear in response to the first at least one wavelength and decrease the volume of the internal chamber and decrease air pressure in the middle ear in response to the second at least one wavelength. The first photodetector may transmit the second at least one wavelength of light such that the first photodetector can be positioned at least partially over the second photodetector to decrease the size of assembly 30. The first photodetector can be coupled to the sound transducer with a first polarity and the second photodetector coupled to the second photodetector with a second polarity, the first polarity opposite the second polarity. The first photodetector and the second photodetector may comprise at least one photovoltaic material such as crystalline silicon, amorphous silicon, micromorphous silicon, black silicon, cadmium telluride, copper indium gallium selenide, and the like. In some embodiments, the at least one of photodetector may comprise black silicon, for example as described in U.S. Pat. Nos. 7,354,792 and 7,390,689 and available under from SiOnyx, Inc. of Beverly, Mass. Alternatively or in combination, the assembly may comprise separated power and signal architectures, for example with the assembly comprising one photodetector. The first at least one wavelength of light and the second at least one wavelength of light may be pulse width modulated. Examples of circuitry and systems that can be configured to optically couple the implantable transducer assembly 30 with input transducer assembly 20 can be found in U.S. App. Nos. 61/073,271, filed Jun. 17, 2008, entitled "Optical Electro-Mechanical Hearing Devices With Combined Power and Signal Architectures"; 61/139,522, filed Dec. 19, 2008, entitled "Optical Electro-Mechanical Hearing Devices With Combined Power and Signal Architectures"; 61/139,522, filed May 11, 2009, entitled "Optical Electro-Mechanical Hearing Devices With Combined Power and Signal Architectures"; 61/073,281, filed Jun. 17, 2008, entitled "Optical Electro-Mechanical Hearing Devices with Separate Power and Signal"; 61/139,520, filed Dec. 19, 2008, entitled "Optical Electro-Mechanical Hearing Devices with Separate Power and Signal"; the full disclosures of which are incorporated by reference and suitable for combination in accordance with embodiments of the present invention.

FIG. 1C1 shows implantable output transducer assembly 30 in which sound transducer 32 comprises a balanced armature transducer 32B and a diaphragm 32D. The balanced armature transducer is coupled to a diaphragm 32D. Diaphragm 32D is oriented toward a round window of the middle ear. The balanced armature transducer 32B may comprise a reed 32R. Reed 32R can be coupled to diaphragm 32D with a post 32P extending there between. Diaphragm 32D may comprise a rigid inner portion configured to vibrate and emit the sound pressure SO, and an outer bellows portion configured to flex. The inner portion of diaphragm 32D may also be flexible. The outer bellow portion can be coupled to a housing 32H. In many embodiments housing 32H comprises diaphragm 32D, bellows 32B and the at least one transducer 34, such that the assembly is hermetically sealed.

The housing 32H and diaphragm 32D may define an inner chamber 32C comprising a volume 32V. When diaphragm 32D is pushed outward by the balanced armature transducer 32B, the volume of chamber 32 is increased to a first volume. When diaphragm 32D is pulled inward by the balanced armature transducer 32B, the volume of chamber 32 is decreased to a second volume, in which the second volume is less than the first volume. For many frequencies of sound, the wavelength of sound is substantially greater than the dimensions of the inner ear, such that the orientation of the transducer may not be important. For example, with sound frequencies of about 1 kHz and based on a speed of sound of about 320 m/s, the wavelength of a sound pressure wave is about 0.32 m, which can be substantially greater than the dimensions of the middle ear. However, with sound having a frequency of about 10 kHz or more, the wavelength is about 0.032 m (32 mm), which is closer to the dimensions of the middle ear. However, as 32 mm can be substantially greater than the dimensions of the middle ear, the transducer configured to increase sound pressure of the middle ear, for example based on volume, can couple to the vibratory structures of the ear with sound pressure comprising frequencies up to at least about 20 kHz, near the upper natural limit for audible frequencies.

The output transducer assembly 30 comprises the at least one transducer 32, in which the at least one transducer 32 may comprise at least one photodetector oriented toward the eardrum of the middle ear so as to receive light transmitted along the ear canal and through the eardrum TM. The at least one photodetector may comprise one or more photo detectors as described above.

Figure 2:
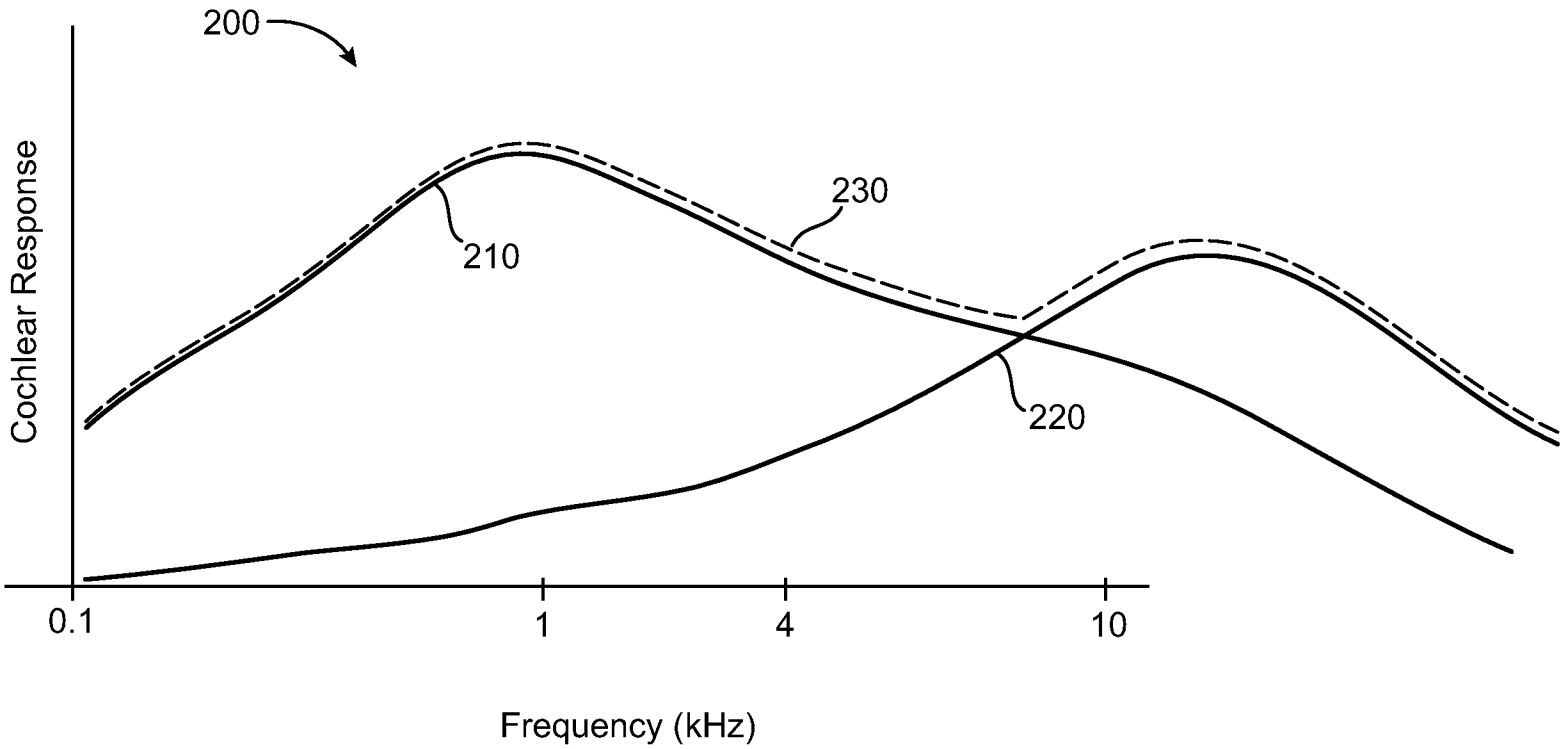

FIG. 1C2 shows output transducer assembly 30 comprising a portion comprising an extension 32E sized to fit in the round window niche. Extension 32E can be sized in many ways to fit in the round window niche NI. For example, the extension 32E may comprise a maximum dimension across of no more than about 3 mm. Extension 32E may comprise a circular cross section, or may comprise an oval, for example elliptical cross section so as to correspond to the round window niche NI.

The housing 32H may substantially enclose the diaphragm 32D comprising bellows 32B, and the balanced armature transducer 32B. A channel 32CH may extend from diaphragm 32D to an opening 32O in extension 32E, so as to emit sound pressure SO from opening 32O. Channel 32CH may comprise a cross sectional dimension, for example a diameter 32CD, so as to concentrate sound pressure near opening 320 of channel 32CH. For example, diaphragm 32D may comprise a surface area corresponding to a first area along channel 32CH, and opening 32O may comprise a area corresponding to a second area of channel 32, in which the second area is at least about five times the first area so as to concentrate sound pressure near the opening 32O positioned near the round window RW. The second area may be ten times the first area, for example. A person of ordinary skill in the art can conduct empirical studies based on the teachings described herein to determine the frequency dependence of the relative coupling of the opening to the round window and the eardrum, size the opening and diaphragm accordingly. The circuitry of the sound processor may also be adjusted so as to compensate for different gains among the frequencies, based on the transfer function of the relative coupling of the eardrum and round window to the sound transducer of the implantable assembly.

Figure 3:
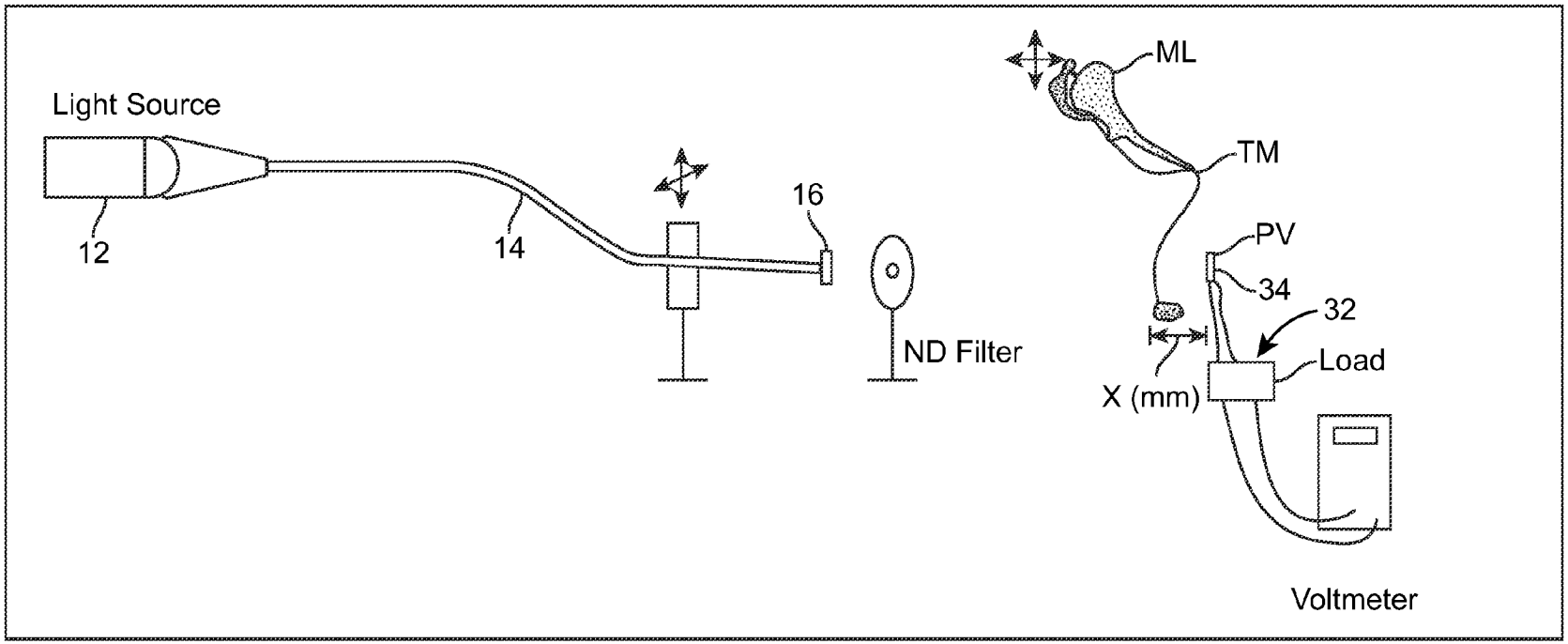

FIG. 1C3 shows an input transducer assembly 20 comprising an optical fiber 14 and collimation optics 16 coupled to an output transducer assembly 30 having a convexly curved photodetector 31 to receive light λs scattered from the tympanic membrane and a concavely curved surface 33 to receive a portion of the promontory. The collimation optics 16, for example a lens positioned a distance from the end of the optical fiber 14 emit electromagnetic energy comprising light λ that strikes the eardrum TM and is scattered. The collimation optics can collimate the emitted light beam to a full angle no more than about 20 degrees. The convexly curved surface 31 of the photodetector receives the scattered light and comprises a surface area greater than the area of the eardrum illuminated with the light beam emitted from collimation optics. For example, the surface area of the photodector can be at least about twice the surface area of the eardrum illuminated with the light beam, and the illumination of the light beam can be defined based on the full width half maximum intensity of the light beam illuminating the eardrum. The transducer 32 is disposed between the convexly curved surface of photodector 31 and the concavely curved surface 33. The convexly curved photodector 31 is shaped for placement near the eardrum TM to efficiently couple light emitted from the optical fiber of the input assembly 20 to the photodetector of the output assembly 30, for example as described in the below experimental section. The output transducer assembly can be sized for placement in the posterior portion of the middle ear cavity, for example the posterior inferior portion, such that light can be transmitted through the posterior portion of the eardrum, for example through the inferior posterior portion.

The convexly curved surface and concavely curved surfaces as described herein may comprise one or more of many shapes such as a spherical shape, a toric shape, a cylindrical shape, a piecewise continuous shape a conical shape, and combinations thereof, for example.

FIG. 1C4 shows an input transducer assembly 20 comprising an optical fiber 14 and collimation optics 16 coupled to an output transducer assembly 30 having at least one convexly curved lens 34 disposed on a photodetector to receive light λs scattered from the tympanic membrane and a concavely curved surface to receive a portion of the promontory. The at least one convexly curved lens may comprise a spherical lens, an aspheric lens, a cylindrical lens, a toric lens, an array of cylindrical lenses, or an array of spherical lenses, or combinations thereof. For example, the at least one lens may comprise a plano convex lens and can be positioned on a substantially flat photodetector so as to couple to the tympanic membrane. The at least one lens may comprise an array of spherical plano convex lenslets, for example. Alternatively or in combination, the at least one lens may comprise an array of cylindrical lenslets, in which each cylindrical lenslet comprises a convex surface toward the tympanic membrane and a flat surface oriented toward the photovoltaic PV, and the array of cylindrical lenslets may comprise a single piece of material having the lenslets formed thereon on a first side with a second flat side oriented toward the photovoltaic and opposite the first side.

FIG. 1C5 shows an output transducer assembly comprising a balanced armature transducer disposed between a photodetector to receive light scattered from the tympanic membrane and a concavely curved surface to receive a portion of the promontory. The balanced armature transducer 32B can be positioned with the at least one detector 34 comprising a photovoltaic PV positioned on housing 32H of the balanced armature transducer. The balanced armature transducer 32B comprises a permanent magnet, for example a C-shaped permanent magnet, and a moving magnetic armature that is pivoted so it can move in the field of the permanent magnet. The lens 35 can be positioned on the photovoltaic PV, for example adhered with an adhesive. A current 321 from the photovoltaic PV powers the balanced armature transducer 32B. The balanced armature transducer 32B has reed 32R extending to post 32P, which post is coupled to diaphragm 32D. Diaphragm 32D is coupled to channel 32CH. Channel 32CH extends to at least one opening 320. The at least one opening 32O can be sealed with an elastic sealant such as an elastomer, and the sealant can vibrate to emit sound SO into the middle ear cavity when volume 32V of chamber 32C changes in response vibration of diaphragm 32D.

FIG. 1C6 shows output transducer assembly 30 comprising balanced armature transducer 32B disposed between the photovoltaic PV to receive light scattered from the tympanic membrane and a concavely curved surface 33 to receive a portion of the promontory, in which a surface of the photodetector comprising photovoltaic PV is inclined relative to the balanced armature transducer 32B and concavely curved surface 33. The housing 32H may comprise an inclined surface to support the inclined photovoltaic PV.

The output transducer assembly 30 is shaped for placement in the middle ear cavity such that light transmitted through the posterior portion of the eardrum is received with the photovoltaic PV. A first portion of the output transducer assembly 30 may comprise a the diaphragm and can be sized for placement in the middle ear cavity toward the umbo. A second portion of the transducer 32B comprising the C-shaped permanent magnet can be sized for placement in the middle ear cavity at a location oriented toward the inferior portion of the middle ear cavity away from the umbo. As the spacing from the umbo to the promontory can be less than the spacing from the inferior/posterior portion of the annulus to the promontory, the thickness of the first portion extending between the photovoltaic PV and the concavely curved surface 33 can be less than the thickness of the second portion extending between the photovoltaic PV and the concavely curved surface 33. The first portion may comprise the diaphragm and post and the second portion may comprise the permanent magnet, such that the first thickness can be substantially less than the second thickness. The second portion may comprise substantially more mass than the first portion, for example a majority of the mass of the output transducer assembly 32B, such that the second portion having the greater mass is positioned under the first portion having the lesser mass such that the output transducer assembly can be stable when supported in the middle ear cavity. The anchoring structure 36 having holes extending therethrough for tissue integration may support a portion of the weight of the output transducer assembly 30, such that the position of the output transducer assembly supported in the middle ear cavity is maintained.

The lens 35 can be positioned on the photovoltaic PV as described above and inclined. Alternatively or in combination, the photodetector comprising photovoltaic PV may comprise the convexly curved surface as described above.

Figure 1D:
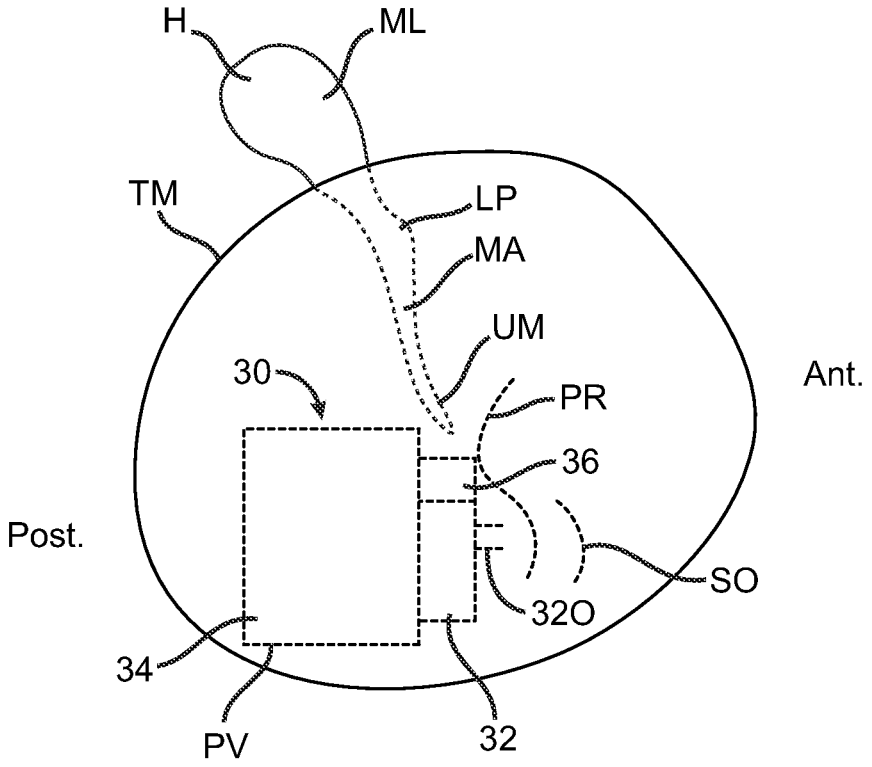
FIG. 1D shows a schematic illustration of a medial view from the ear canal through the eardrum of the output transducer assembly comprising the speaker positioned in the middle ear of the user as in FIGS. 1 and 1C.

FIG. 1D shows a schematic illustration of a medial view from the ear canal through the eardrum of the output transducer assembly comprising the speaker positioned in the middle ear cavity of the user as in FIGS. 1 and 1C. The output transducer assembly 30 is positioned on promontory PR such that at least one transducer assembly 34 is oriented to receive electromagnetic energy transmitted through eardrum TM. The position and the orientation of the at least one transducer 34 may remain substantially fixed when electromagnetic energy is transmitted through the eardrum to vibrate the eardrum and ossicles with sound transducer 32. Consequently, the efficiency of transfer of the electromagnetic energy incident on the at least one transducer 34 remains substantially constant, such that acoustic distortion due to motion of the at least one transducer when the eardrum and ossicles vibrate is substantially inhibited. For example, the at least one transducer may comprise at least one photodetector PV, as described above, which is visible through the eardrum TM such that light can be transmitted from the ear canal EC through the eardrum TM so as to transmit the power and signal through the eardrum TM with light.

Figure 1E:
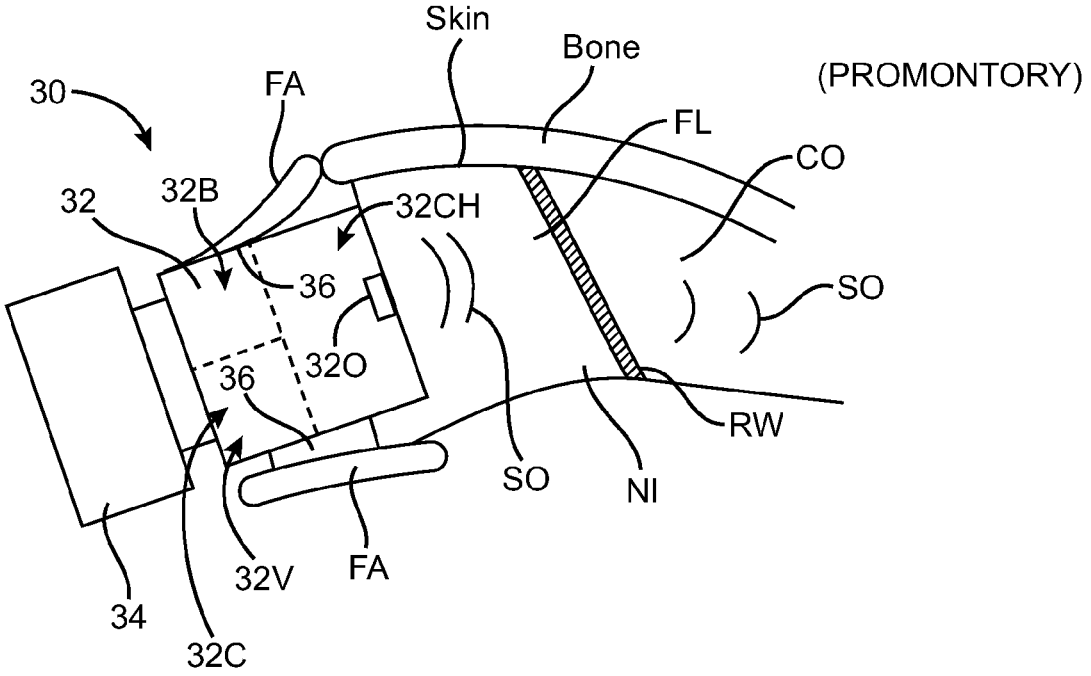
FIG. 1E shows a transducer assembly positioned in the middle ear with the speaker oriented toward the round window niche of the middle ear so as to couple to the round window.

FIG. 1E shows a transducer assembly positioned in the middle ear with the output of the sound transducer oriented toward the round window niche of the middle ear so as to couple to the round window. The at least one transducer assembly 34 is oriented to receive electromagnetic radiation transmitted through eardrum TM. An upper anchor 36 and a lower anchor 36 are connected to bone and skin that define the round window niche NI with fascia FA, which is a layer of fibrous tissue, such that assembly 30 is affixed to substantially fixed structures of the middle ear. At least a portion of transducer assembly 30 is sized to fit within the round window niche NI. Sound transducer 32 is oriented toward round window RW so as to couple to round window RW with a fluid FL disposed between sound transducer 32 and round window RW. Sound pressure SO emitted from sound transducer 32 is transmitted through round window RW into the cochlea. The fluid FL may comprise air that can be present naturally in middle ear ME. Alternatively or in combination, fluid FL may comprise a liquid such as an oil, a mineral oil, a silicone oil, a hydrophobic liquid, or the like. A volume of the liquid extending from the speaker to the round window may comprise no more than about 50 uL, for example no more than about 20 uL. The transducer 32 may comprise a balanced armature transducer 32B with diaphragm 32D coupled to opening 32O as described above.

The coupling of the sound 32SO to the round window with the opening 32O positioned in the round window niche can decrease feedback to a microphone positioned in the ear canal or near the ear canal opening as described above. For example, one or more of the housing 32H, the upper anchor 36, the lower anchor 36H or the fascia FA can be positioned so as to occlude at least partially the propagation of sound from the round window niche such that the sound pressure transmitted from the diaphragm 32D through opening 32O is directed substantially toward the round window with localized coupling, and corresponding sound propagation away from the round window niche can be substantially inhibited and corresponding feedback sound pressure at the microphone can be substantially reduced.

The round window niche comprises a volume substantially less than a volume of the middle ear cavity, and the round window comprises a surface area substantially less than the surface area of the eardrum, such that the round window can be driven more efficiently from the round window niche than the tympanic membrane can be driven from the middle ear cavity in many embodiments. For example, the round window niche may comprise a volume of no more than about 0.1 mL and the middle ear cavity may comprise a volume within a range from about 2 to 10 mL. As the volume of air to displace within the round window niche can be much lower than the volume of air to displace within the middle ear, the coupling to the round window niche can be more efficient. Also, the surface area of the eardrum is substantially greater than the surface area of the round window, such that a change in volume 32V of chamber 32C can displace the round window farther than the eardrum, so as to displace the components of hearing transduction pathway a greater distance. For example, when tissue is disposed over the transducer to at least partially occlude the round window niche with the opening 32SO in fluidic communication with the round window, the volumetric displacement of the round window may correspond substantially to the displacement volume 32V of transducer 32B, such that the round window can displace the hearing conduction pathway a substantial distance based on the decreased surface area of the round window and the displacement volume 32V of the transducer chamber 32C. The eardrum may comprise a surface area at least about ten times the surface area of the round window, such that a displacement of transducer volume 32V directed to the round window with fluidic coupling can displace the hearing transduction pathway a substantially greater distance than when the displacement volume 32V is directed to the eardrum, for example.

Figure 1F:
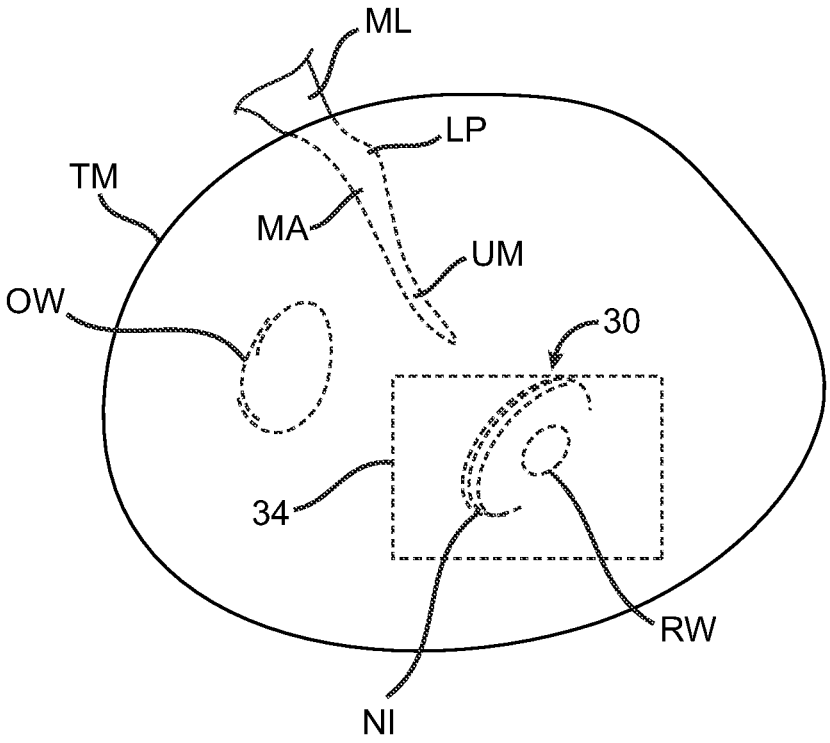
FIG. 1F shows a schematic illustration of a medial view the output transducer assembly comprising the speaker positioned in the middle ear of the user as in FIG. 1E.

FIG. 1F shows a schematic illustration of a medial view the output transducer assembly comprising the speaker positioned in the middle ear of the user as in FIG. 1E. Assembly 30 is positioned in the middle ear behind eardrum TM. The at least one transducer 34 configured to receive electromagnetic radiation is oriented toward eardrum TM.

FIG. 2 shows the frequency response 200 of the cochlea to the transducer assembly and the contribution of the eardrum and round window. The frequency response 200 may comprise a transfer function of the cochlear stimulation in response to the implanted output transducer assembly. The frequency response 200 may comprise an eardrum component 210 and a round window component 220. The round window component can be combined with the tympanic membrane component to determine the combined transfer function 230 of the implanted output transducer assembly 30 to the cochlea. Although there may be some coupling of the transducer to the cochlea with bone conduction from the promontory to the cochlea CO, the bone conduction coupling is substantially less than the acoustic coupling to the eardrum TM and round window RO as shown.

The frequency response 200 can be determined for many configurations of the output transducer assembly, as described above. For example, the frequency response 200 can be determined for the output coupled to the round window niche as described above. For frequencies below about 4 kHz, the output transducer assembly can couple substantially to the eardrum TM with sound pressure. For frequencies above about 5 kHz, for example above about 10 Hz, the output transducer assembly can couple substantially to the round window. As the tympanic membrane and malleus may comprise complex motions, for example rotations as described above, the gain of the coupling of the transducer assembly can decrease for frequencies above about 1 kHz.

The frequency response 200 shown above illustrates a transfer function according to some embodiments. Based on the teachings described herein a person of ordinary skill in the art can conduct studies with many configurations of the output transducer assembly so as to determine suitable configurations and transfer functions. For example, the portion inserted into the niche may be sized to the round window niche to improve coupling to the round window. Further, the tissue grafted to the assembly may at least partially form a seal between the round window and the output of assembly 30, so as to improve coupling and the gain of round window portion 220.

The sound processor circuitry, for example of the BTE, may be programmed based on the transfer function determined based on frequency response 200 for the embodiment placed in the user's middle ear.

Human Eardrum Transmission Experiment

The below described experiment was conducted to measure transmission of infrared light through the eardrum and determine arrangements of the input assembly 20 and output assembly 30.

Objective: To determine the amount of light transmission loss through a human eardrum at posterior, inferior and anterior positions and the amount of scatter by the eardrum.

Procedure: A fiber optic coupled laser diode light source was aligned with a photodiode optical detector. An eardrum was placed in line and the change in optical output from the photodiode determined. FIG. 3 shows the experimental setup. The eardrum is mounted to a x,y,z translation stage which allows a change to different positions of the eardrum that the light goes through.

Materials:

Light source—1480 nm laser diode coupled to a fiber (250 um diameter, 80 um core);

PhotoDiode—1480 nm photodiode (5.5 mm2);

Load—RLC electrical circuit equivalent to that of a balanced armature transducer coupled to a diaphragm, for example as commercially available from Knowles;

Collimation optics and a Neutral Density Filter (NE20B);

DC Voltmeter (Fluke 8060A);

Translation stages; and

Human cadaver eardrum with attached malleus (incus and other medial components removed)

Results

No Tympanic Membrane

The current was set such that the photodiode was in the saturation region. A neutral density (ND) filter was used to attenuate the light output to reduced the PD response. The measurements indicate that the ND filter attenuated the light source by 20.5 dB. This ensured that all measurements reported are from the linear region.

The photodiode voltage in response to the collimated light beam without the eardrum was measured at the beginning of the measurements and at the end of experiment. The difference was less than 1%.

With no TM and ND filter, the output in mV was 349. With the ND filer and no TM, this output decreased to within a range from about 32.9 to 33.1, corresponding to a linear change of 0.095 and −20.5 dB.

With Tympanic Membrane

Measurements were made at anterior, inferior, and posterior positions of the eardrum. The eardrum was moved at different locations relative to the photodiode and it's distance X (in mm) approximated. Table 1 shows the measured voltages corresponding to the different positions and different eardrum locations.

TABLE 1

Measured photodiode voltages corresponding to transmission loss from the eardrum

| x (mm) | 0.1 | 0.5 | 1 | 2 | 3 |
|---|---|---|---|---|---|
| Posterior | 28 | 26.6 | 25.4 | 23.4 | 20.6 |
| Inferior | | | 23.6 | 21.1 | 17.1 |
| Anterior | | | 21.4 | 20.2 | 18.2 |

The posterior placement shows the highest voltage for all distances and has values of 28, 26.6, 25.4 23.4 and 20.6 for distances of 0.1, 0.5, 1, 2 and 3 mm, respectively.

For each eardrum position and location, the optical fiber was adjusted to maximize the PD voltage. This ensured that the light beam was maximally on the photodiode surface and that the measured response was due to transmission loss and not due to misalignments.

Calculations

The measured voltages were converted to percent transmission loss (hereinafter "TL") as follows:

$$\%TL=((V_{NoTM}-V_{WithTM})/V_{NoTM})*100$$

where $V_{NoTM}$ is the measured voltage with no tympanic membrane and $V_{WithTM}$ is the measured voltage with the tympanic membrane Table 2 below shows the calculated % Transmission Loss using the above equation.

TABLE 2

| % Transmission loss | | | | | |
|---|---|---|---|---|---|
| x (mm) | 0.1 | 0.5 | 1 | 2 | 3 |
| Posterior | 16 | 20 | 23 | 29 | 38 |
| Inferior | | | 29 | 36 | 48 |
| Anterior | | | 35 | 39 | 45 |
| Average | | | 29 | 35 | 44 |

At all locations the posterior placement showed the least transmission loss and values of 16, 20, 23, 29 and 38% at distances of 0.1, 0.5, 1, 2 and 3 mm, respectively.

With the PD very close to the eardrum (within about 0.1 mm), the TL is about 16%. The TL could only be measured for the Posterior position.

Of the three positions of the eardrum, the posterior position is better than the inferior position by 6-10%, and better than the anterior position by 7-12%.

As the eardrum is moved away from the PD, the transmission loss increases linearly for all three positions. The average transmission loss is about 29%, 35%, and 44% averaged across the three different positions for the 1, 2 and 3 mm locations respectively.

Experimental Conclusions

The transmission loss due to the eardrum is lowest at the posterior position (16%). The loss increases as the photodiode is moved away from the eardrum due to scatter of the collimated beam by the eardrum. At 3 mm from the eardrum, the average loss was as much as 44%. These data shown the unexpected result that there is more loss due to light scatter at angles away from the detector surface induced by the eardrum than due to transmission of light through the eardrum, and the detector and coupler such as a lens can be shaped appropriately so as to collect transmitted light scattered by the eardrum. These data also show the unexpected result that light transmission is higher through the posterior portion of the eardrum.

As the eardrum can move, the detector in a living person should be at least about 0.5 mm from the eardrum. The data suggest that a detector and/or component such as a lens can be shaped to fit the eardrum and provide improved transmission, for example shape with one or more of an inclined surface, a curved surface, and can be positioned within a range from about 0.5 mm to about 2 mm, for example.

The above data shows that illuminating a portion of the eardrum and placing a detector near the illuminated portion, for example can achieve transmission coupling efficiency between the projected light beam and detector of a least about 50% (corresponding to 50% loss), for example at least about 60% (corresponding to 40% loss). With posterior placement of the detector and illumination of a portion of the posterior region of the eardrum, the coupling efficiency can be at least about 70%, for example 80% or more. These unexpectedly high results for coupling efficiency indicate that illumination of a portion of the eardrum and a detector sized to the illuminated portion can provide efficiencies of at least about 50%. Also, the unexpected substantially lower transmission loss for the posterior portion of the eardrum as compared to each of the inferior and anterior portions indicates that transmission can be unexpectedly improved with posterior placement when most of the eardrum is illuminated. For example, the transmission coupling efficiency of the optical fiber to the photodetector can be improved substantially when the photodetector is positioned in the posterior portion of the middle ear cavity, for example the inferior posterior portion of the middle ear cavity, and an optical fiber is positioned in the ear canal without collimation optics such that light is emitted directly into the ear canal from the end of the optical fiber.

While the above is a complete description of the preferred embodiments of the invention, various alternatives, modifications, and equivalents may be used. Therefore, the above description should not be taken as limiting in scope of the present invention, which is defined solely by the appended claims and the equivalents thereof.

What is claimed is:

1. A device to transmit sound to an ear of a user, the ear comprising a middle ear and an eardrum, the device comprising:

an output transducer assembly configured to couple to a tissue of a middle ear of a user, the assembly comprising, at least one receiving transducer configured to receive electromagnetic energy transmitted through the eardrum; and a sound transducer coupled to the at least one receiving transducer and configured to transmit the sound to the user in response to the electromagnetic energy when the output transducer assembly is supported with the tissue of the middle ear of the user, wherein a portion of the output transducer assembly comprises an extension sized to couple with a round window with air extending between the sound transducer and the round window, the extension comprising a channel having an opening, wherein the opening of the channel of the extension of the sound transducer is oriented toward the round window to transmit a majority of low frequency sound having frequencies below about 4 kHz to the user via the eardrum and to transmit a majority of high frequency sound having frequencies above about 5 kHz to the user via the round window, and wherein the output transducer assembly further comprises a sound processor configured to provide variable gains among the low and high frequency sounds based on a combined transfer function of a frequency response of an eardrum component and a frequency response of a round window component, wherein the frequency response of the eardrum component corresponds to a stimulation of the eardrum by the output transducer assembly and wherein the frequency response of the round window corresponds to a stimulation of the round window by the output transducer assembly.

2. The device of claim 1 wherein the sound transducer comprises a speaker.

3. The device of claim 1 wherein the sound transducer comprises a diaphragm configured to vibrate and displace air to transmit the sound to the user.

4. The device of claim 3 wherein the output transducer assembly further comprises a housing extending at least partially around the sound transducer comprising the diaphragm to define a chamber within the output transducer assembly.

5. The device of claim 4, wherein the chamber comprises a volume and the sound transducer is configured to increase the volume to increase an air pressure of the middle ear and to decrease the volume to decrease the air pressure of the middle ear to transmit the sound to the user.

6. The device of claim 5, wherein the diaphragm is configured to move away from the chamber to increase the volume of the chamber and to move toward the chamber to decrease the volume of the chamber.

7. The device of claim 5, wherein the chamber comprises a sealed chamber to inhibit air flow in and out of the chamber when the diaphragm increases and decreases the volume of the chamber.

8. The device of claim 1 wherein the assembly comprises an anchoring structure configured to anchor the output transducer assembly to a substantially fixed tissue of the middle ear of user.

9. The device of claim 8 wherein the anchoring structure comprises at least one of a flange, a surface coating or holes configured to receive an autograft tissue to affix the assembly to the substantially fixed tissue of the middle ear.

10. The device of claim 8 wherein the substantially fixed tissue of the middle ear comprises a promontory.

11. The device of claim 10 wherein the assembly comprises a concave portion shaped to receive a portion of the promontory.

12. The device of claim 1 wherein the majority of high frequency sound includes frequencies above about 8 kHz.

13. The device of claim 1 wherein the sound transducer is configured to couple to a vibratory structure of the ear when the assembly is affixed to the tissue of the middle ear of the user.

14. The device of claim 13 wherein the vibratory structure of the ear further comprises at least one of an eardrum or an ossicle.

15. The device of claim 13 wherein the sound transducer is configured to further couple to an eardrum of the ear of the user with a fluid.

16. The device of claim 15 wherein the fluid comprises air and the sound transducer is configured to couple to the eardrum of the user with the sound transducer oriented away from the eardrum.

17. The device of claim 1 wherein the channel of the extension extends from a diaphragm to the opening of the channel, the opening positioned on the extension to orient toward the round window when the assembly is supported with the tissue of the middle ear.

18. The device of claim 17 wherein the diaphragm comprises a first cross sectional area of the channel and the opening comprises a second cross sectional area of the channel and wherein the first area is at least about five times the second area to concentrate sound energy at the opening oriented toward the round window.

19. The device of claim 1 wherein the at least one receiving transducer comprises at least one of a photodetector or a coil and wherein the at least one receiving transducer is oriented to receive the electromagnetic radiation transmitted through the eardrum.

20. The device of claim 19 wherein the at least one receiving transducer comprises the photodetector and wherein the photodetector comprises a first photodetector sensitive to a first at least one wavelength of light and a second photodetector sensitive to a second at least one wavelength of light, the first at least one wavelength of light different from the second at least one wavelength of light.

21. The device of claim 1 wherein the sound transducer comprises at least one of a balanced armature transducer, a coil or a magnet.

22. The device of claim 1 further comprising an emitter configured to emit the electromagnetic radiation through the eardrum.

23. The device of claim 22 wherein the emitter comprises at least one of an LED, a laser diode or a coil.

24. The device of claim 22 wherein the emitter is configured for placement within an ear canal of the user.

25. The device of claim 22 wherein the emitter is coupled to a waveguide, the waveguide configured for placement at least partially within the ear canal of the user to couple the emitter to the at least one transducer.

26. The device of claim 1 further comprising a first microphone configured for placement in an ear canal of the user or near an ear canal opening to detect high frequency sound localization cues having frequencies above at least about 4 kHz.

27. The device of claim 26 further comprising a second microphone configured for placement away from the ear canal and the ear canal opening to detect low frequency sound having frequencies below about 4 kHz.

28. The device of claim 1 wherein the at least one receiving transducer comprises a photodetector having a first surface to receive light and wherein the output transducer assembly comprises a second concave surface to receive a portion of a promontory of the middle ear, the first surface opposite the second surface, and wherein the sound transducer is disposed between the first surface and the second concave surface.

29. The device of claim 28 wherein the first surface is inclined relative to the second surface and wherein a first portion of the assembly comprises a first thickness extending between the first surface and the second surface and wherein a second portion of the assembly comprises a second thickness extending between the first surface and the second surface, the first thickness less than the second thickness.

30. The device of claim 29 wherein the sound transducer comprises a balanced armature transducer having a coil, a permanent magnet and a reed, the reed coupled to a diaphragm, and wherein the diaphragm is disposed on the first portion between the first surface and the second surface and the permanent magnet is disposed on the second portion between the first surface and the second surface.

31. The device of claim 28 further comprising at least one lens positioned on the first surface to couple optically to at least a portion of the eardrum and transmit light scattered from the eardrum to the first surface.

32. A device to transmit sound to an ear of a user, the ear comprising a middle ear, the device comprising:

an output transducer assembly configured for placement in the middle ear of the user, the output transducer assembly comprising, at least one photo detector;

a structure to affix the assembly to a substantially fixed tissue of the middle ear;

a speaker coupled to the at least one photodetector and configured to transmit the sound to the user when the assembly is affixed to the substantially fixed tissue of the middle ear;

an extension coupled to the speaker and sized to couple to the round window with air extending between the sound transducer and the round window, the extension comprising a channel to concentrate sound pressure toward the round window such that feedback is reduced, wherein an opening of the channel of the extension is oriented toward the round window to transmit a majority of low frequency sound having frequencies below about 4 kHz to the user via the eardrum and to transmit a majority of high frequency sound having frequencies above about 5 kHz to the user via the round window; and a sound processor configured to provide variable gains among the low and high frequency sounds based on a combined transfer function of a frequency response of an eardrum component and a frequency response of a round window component, wherein the frequency response of the eardrum component corresponds to a stimulation of the eardrum by the output transducer assembly and wherein the frequency response of the round window corresponds to a stimulation of the round window by the output transducer assembly.

33. A device to transmit sound to an ear of a user, the device comprising:

means for transmitting the sound to the ear of the user comprising an extension sized to couple to a round window with air extending between the extension and the round window, the extension comprising a channel having a maximum cross sectional diameter of no more than about 3 mm to concentrate sound pressure near an opening of the channel such that feedback is reduced, wherein the opening of the channel of the extension is oriented toward the round window to transmit a majority of low frequency sound having frequencies below about 4 kHz to the user via the eardrum and to transmit a majority of high frequency sound having frequencies above about 5 kHz to the user via the round window; and means for providing variable gains among the low and high frequency sounds based on a combined transfer function of a frequency response of an eardrum component and a frequency response of a round window component, wherein the frequency response of the eardrum component corresponds to a stimulation of the eardrum by the means for transmitting sound and wherein the frequency response of the round window corresponds to a stimulation of the round window by the means for transmitting sound.

* * * * *